US008397819B2

(12) United States Patent
Tunget

(10) Patent No.: US 8,397,819 B2
(45) Date of Patent: Mar. 19, 2013

(54) SYSTEMS AND METHODS FOR OPERATING A PLURALITY OF WELLS THROUGH A SINGLE BORE

(76) Inventor: Bruce Tunget, Westhill (GB)

( * ) Notice: Subject to any disclaimer, the term of this patent is extended or adjusted under 35 U.S.C. 154(b) by 648 days.

(21) Appl. No.: 12/587,360

(22) Filed: Oct. 6, 2009

(65) Prior Publication Data

US 2010/0126729 A1 May 27, 2010

(30) Foreign Application Priority Data

Nov. 21, 2008 (GB) ..... 0821352.2
Feb. 11, 2009 (GB) ..... 0902198.1
Jun. 23, 2009 (GB) ..... 0910777.2

(51) Int. Cl.
*E21B 43/00* (2006.01)

(52) U.S. Cl. ..... 166/313; 166/50

(58) Field of Classification Search ..... 175/78, 175/61, 270; 166/50, 242.1, 313, 117.5, 166/52, 7, 320, 366, 242.3; 138/114
See application file for complete search history.

(56) References Cited

U.S. PATENT DOCUMENTS 1,900,163 A * 3/1933 Drexler Dana et al. ..... 175/9
3,390,531 A * 7/1968 Johnston et al. ..... 405/227
4,573,541 A * 3/1986 Josse et al. ..... 175/78
6,283,216 B1 * 9/2001 Ohmer ..... 166/313

* cited by examiner

*Primary Examiner* — David Andrews
*Assistant Examiner* — Ronald Runyan
(74) *Attorney, Agent, or Firm* — The Matthews Firm

(57) ABSTRACT

Systems and methods usable to operate on a plurality of wells through a single main bore are disclosed herein. One or more chamber junctions are provided in fluid communication with one or more conduits within the single main bore. Each chamber junction includes a first orifice communicating with the surface through the main bore, and one or more additional orifices in fluid communication with individual wells of the plurality of wells. Through the chamber junctions, each of the wells can be individually or simultaneously accessed. A bore selection tool having an upper opening and at least one lower opening can be inserted into the chamber junction such that the one or more lower openings align with orifices in the chamber junction, enabling selected individual or multiple wells to be accessed through the bore selection tool while other wells are isolated from the chamber junction.

53 Claims, 18 Drawing Sheets

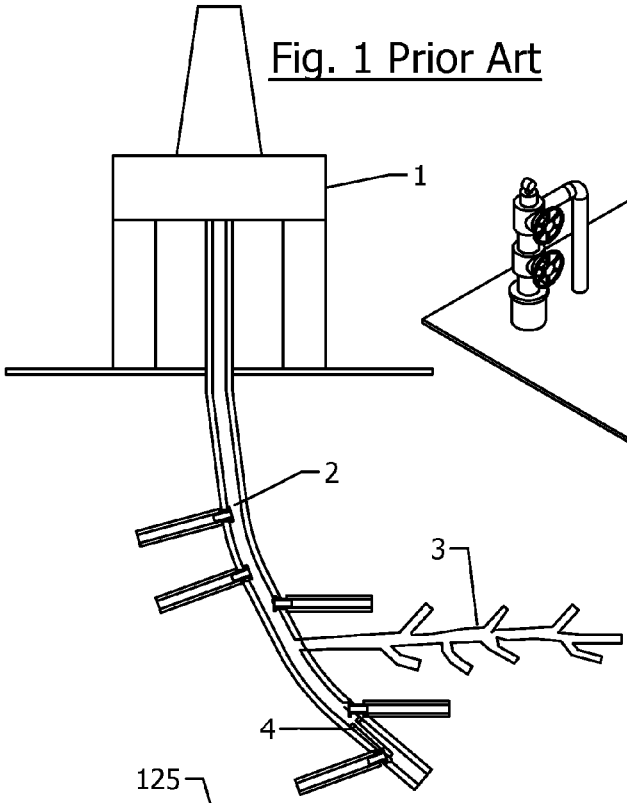
Fig. 1 Prior Art
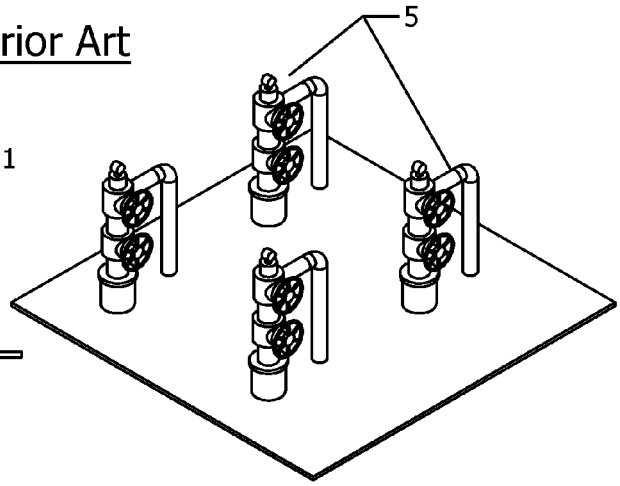
Fig. 2 Prior Art
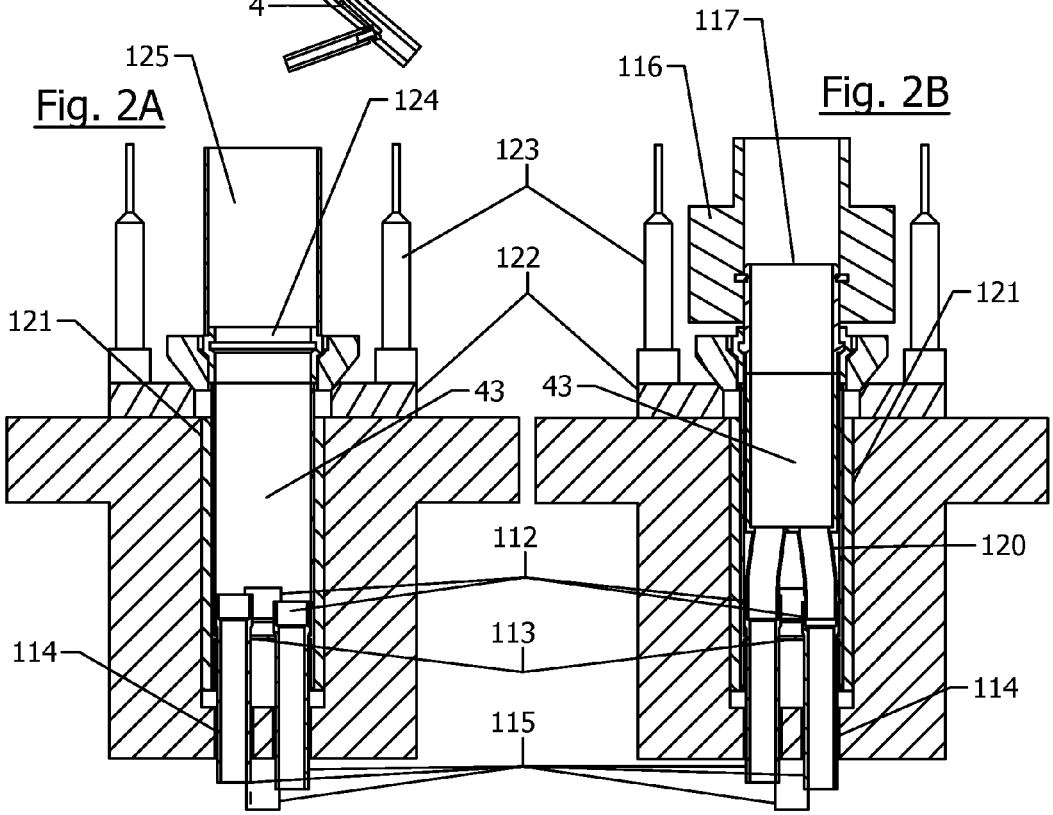
Fig. 2A
Fig. 2B 6
7
7
8
9
10

6
11
13
12

14
6
15
16
17
18
19
6

20
22
21
34

23
24
6
25
26
29
27
28
30
32
33
31
28A
36
35

Cut Plane A
A
38
37
39
Cut Plane B
B 41
40
42
39

41
44
43
42
39

44
45
46
42
46

49
47
50
Cut Plane D
48

47
50
49

38
39
37

41
38
42
39
40

41
43
C
C
C
C
42
C
C
Cut Plane C-C
39

46
41
46
46
42
45

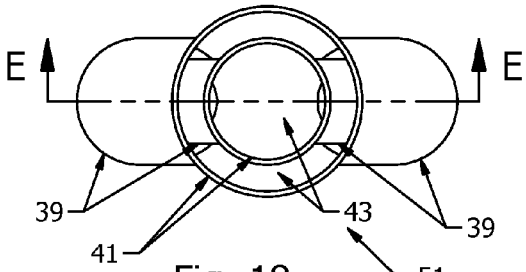
Fig. 18
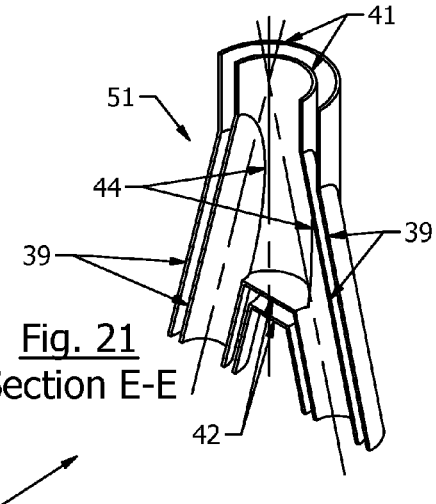
Fig. 21
Section E-E
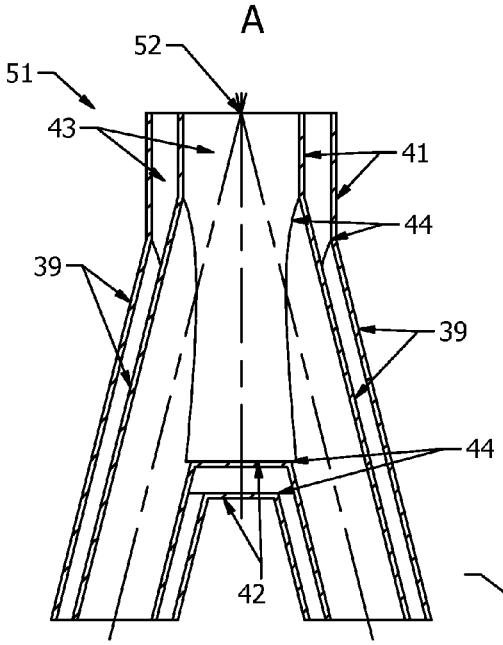
Fig. 19 Section E-E
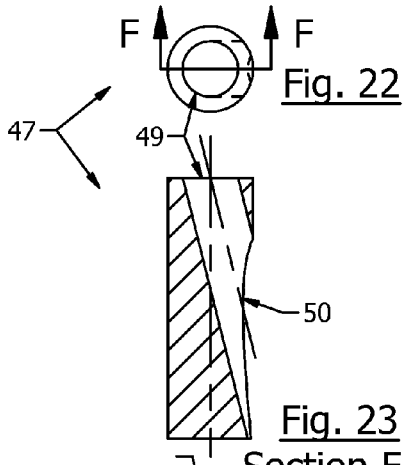
Fig. 22
Fig. 23
Section F-F
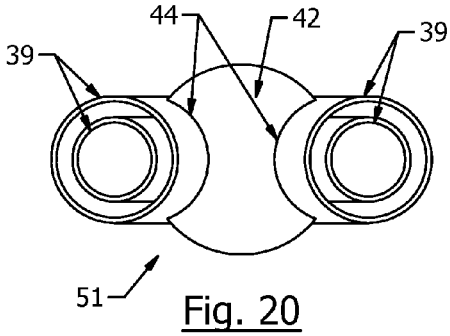
Fig. 20
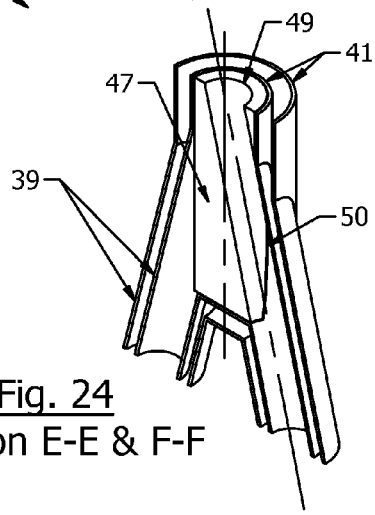
Fig. 24
Section E-E & F-F

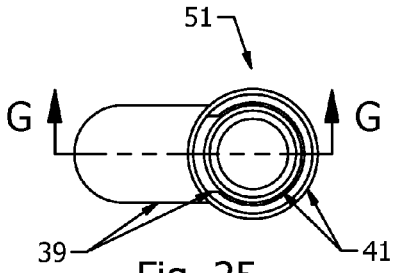
Fig. 25
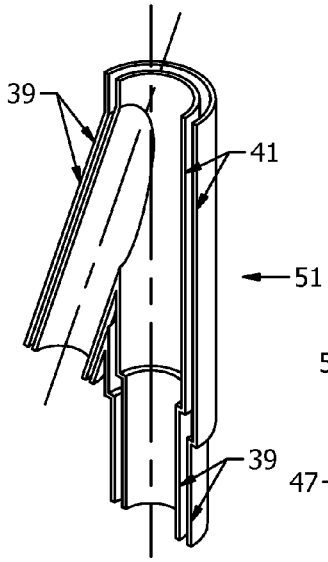
Fig. 28 Section G-G
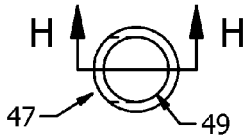
Fig. 30
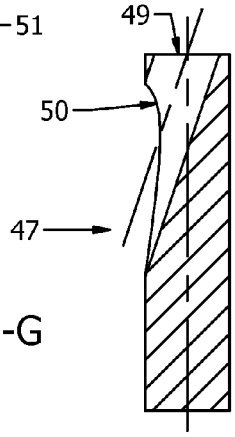
Fig. 31 Section H-H
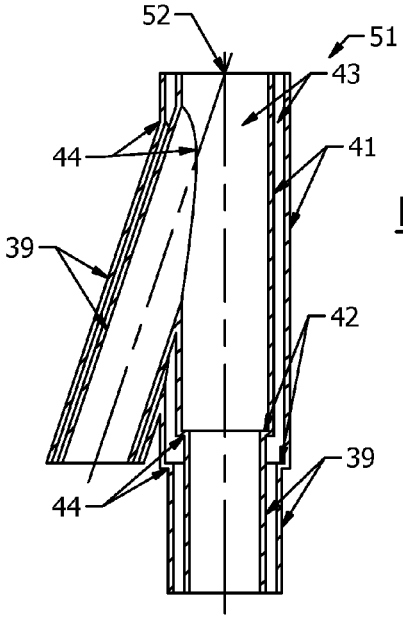
Fig. 26 Section G-G
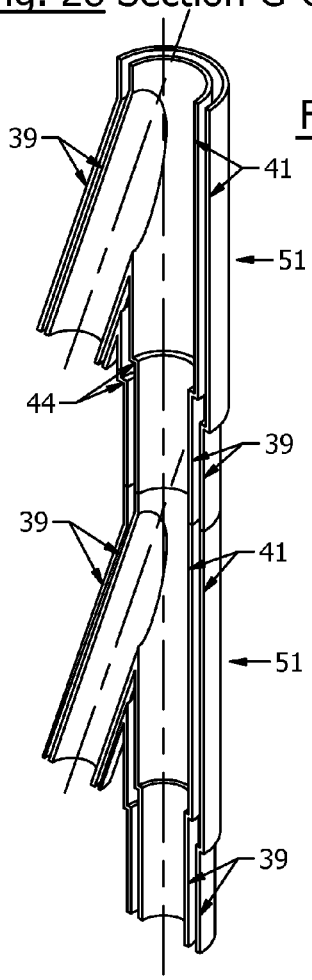
Fig. 29 Section G-G
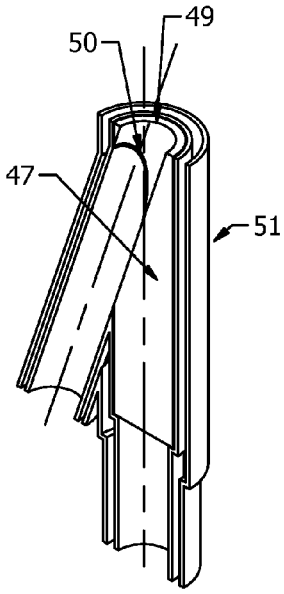
Fig. 32
Sections G-G
& H-H
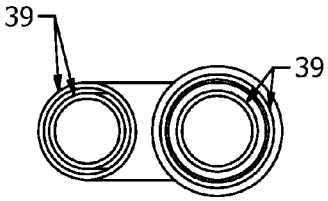
Fig. 27

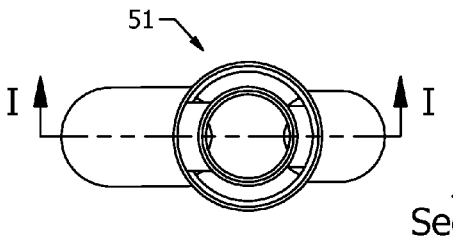
Fig. 33
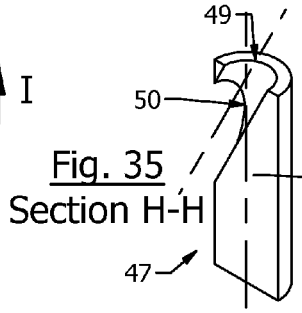
Fig. 35
Section H-H
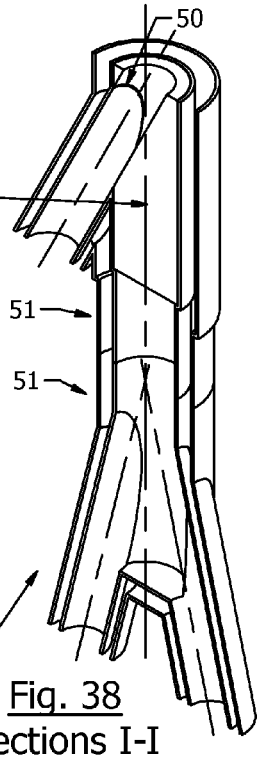
Fig. 36
Section I-I
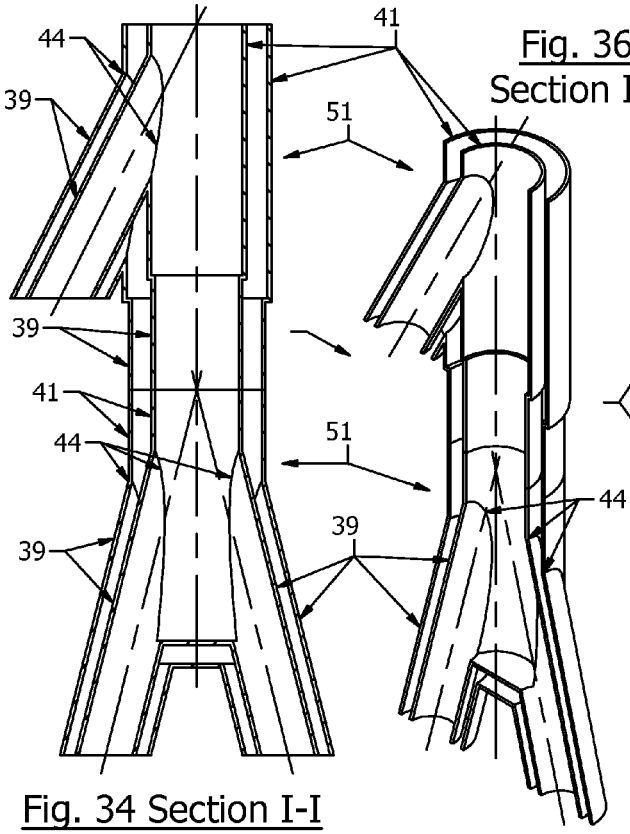
Fig. 34 Section I-I
Fig. 38
Sections I-I
& H-H
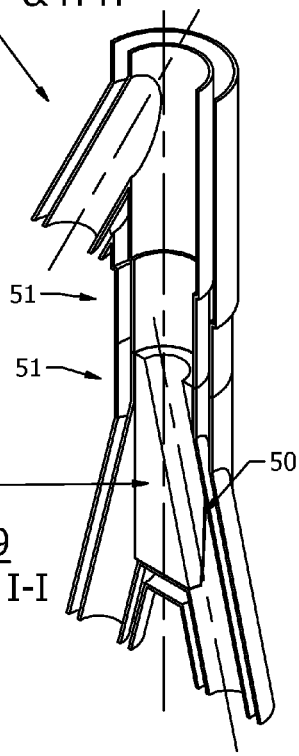
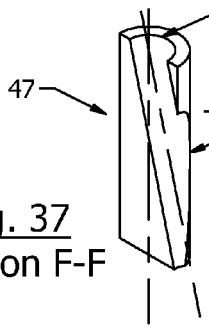
Fig. 37
Section F-F
Fig. 39
Sections I-I
& F-F 53
54
47
56
55
57

58
43
41
59
42
61
39

62
41
43
42
39
64
65
67
66

53
54
47
55
56
57
48
68

Cut Plane A-A
63

43
A
A
B
B

Cut Plane B-B
60
39

Fig. 47
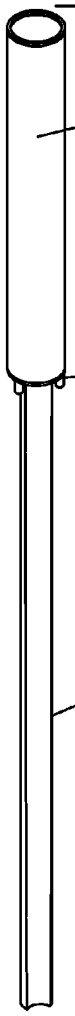
Fig. 48
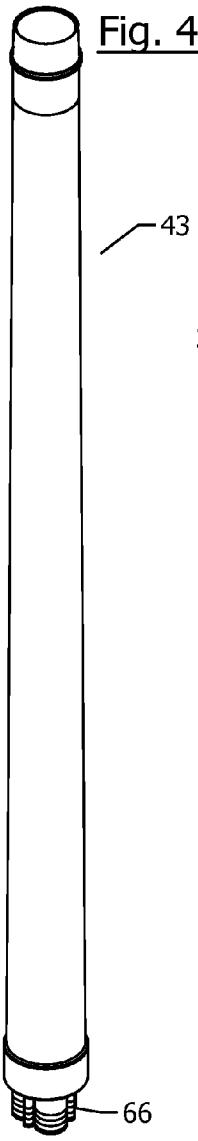
Fig. 49
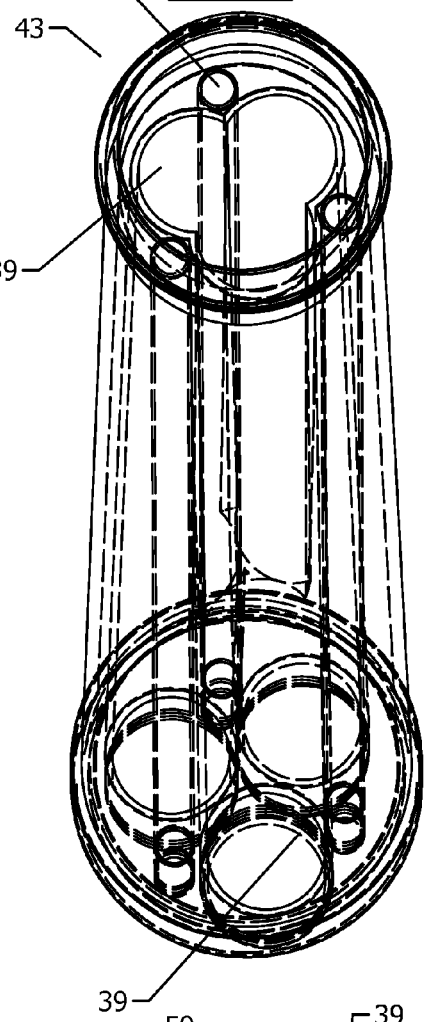
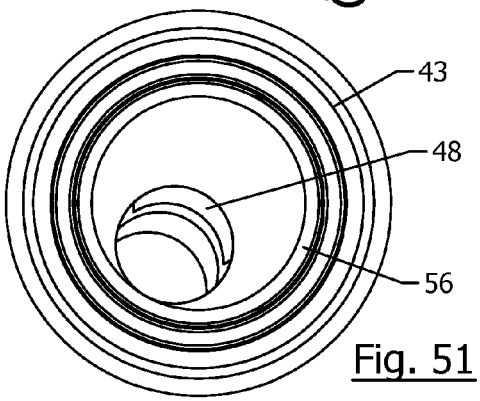
Fig. 51
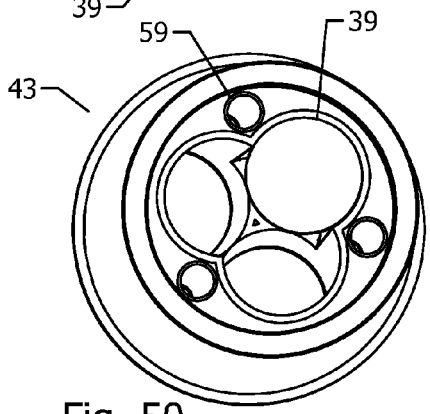
Fig. 50

71
72
73
43
61
39
67
70
74
75
66
76

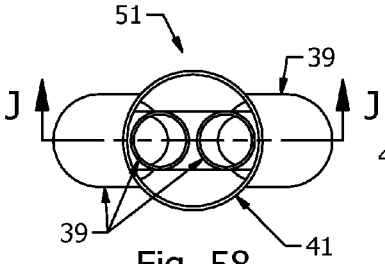
Fig. 58
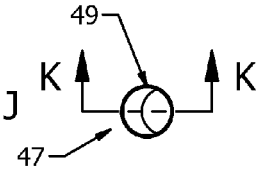
Fig. 60
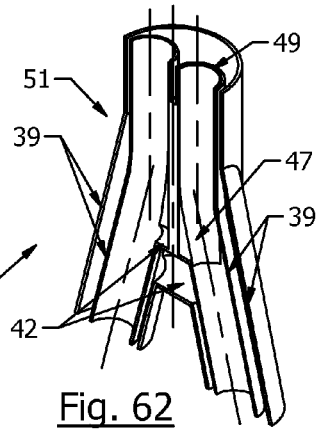
Fig. 62
Section J-J & K-K
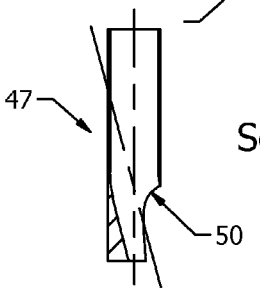
Fig. 61
Section K-K
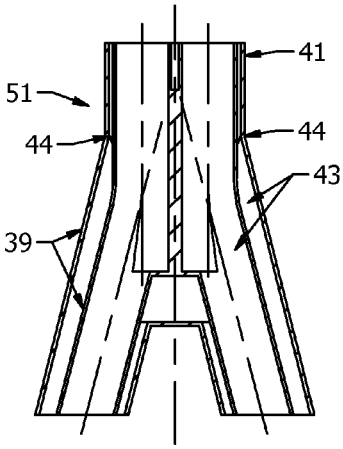
Fig. 59 Section J-J
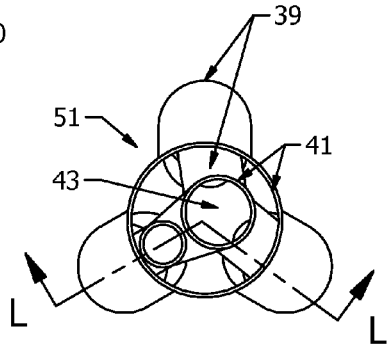
Fig. 63
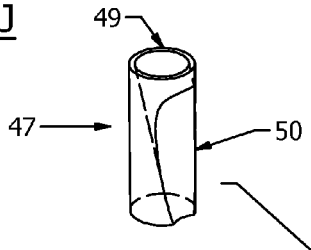
Fig. 64
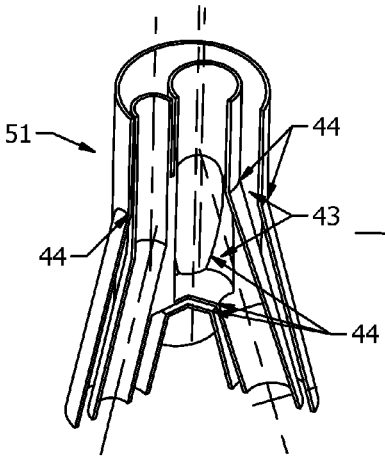
Fig. 65 Section L-L
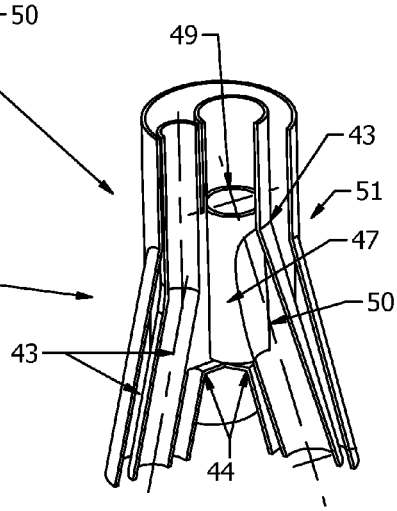
Fig. 66 Section L-L Fig. 67
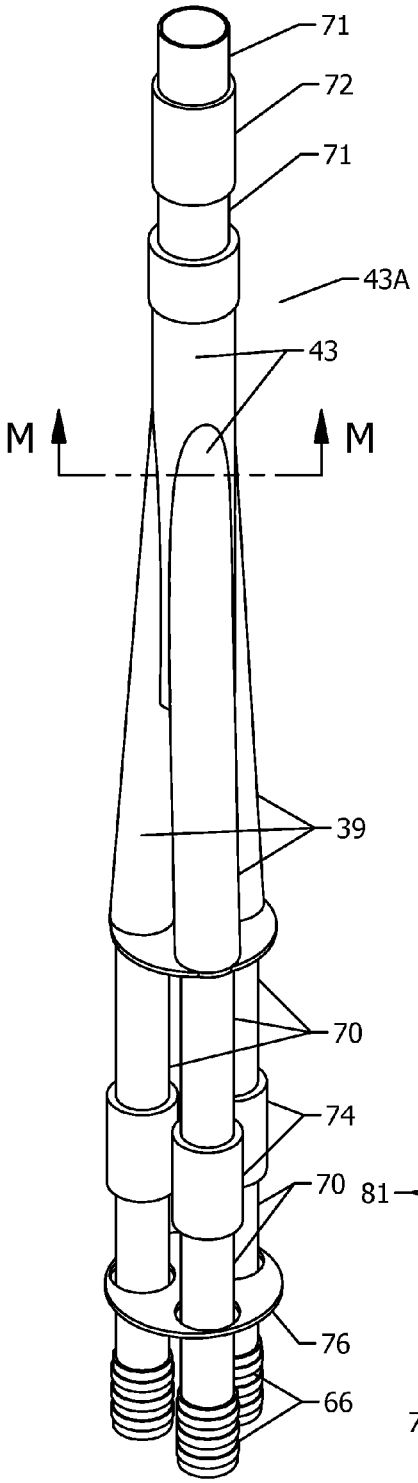
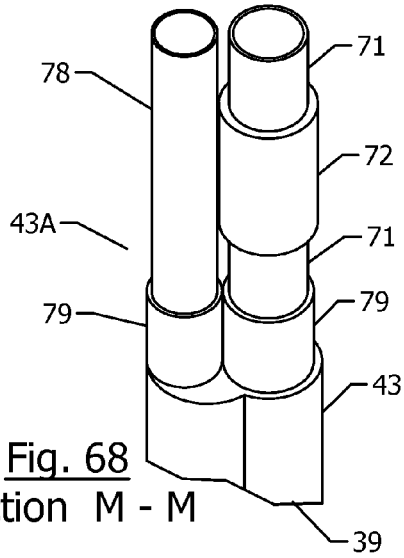
Fig. 68
Section M - M
Fig. 69
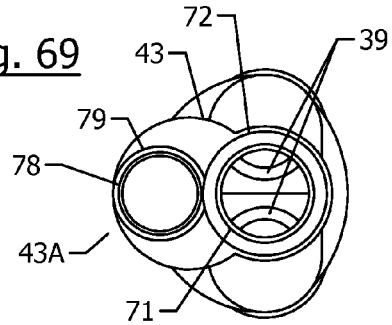
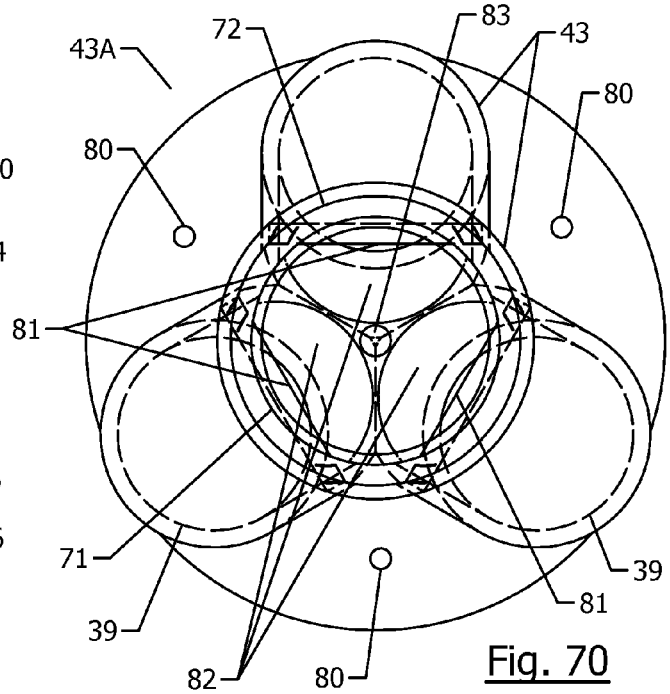
Fig. 70

Fig. 71
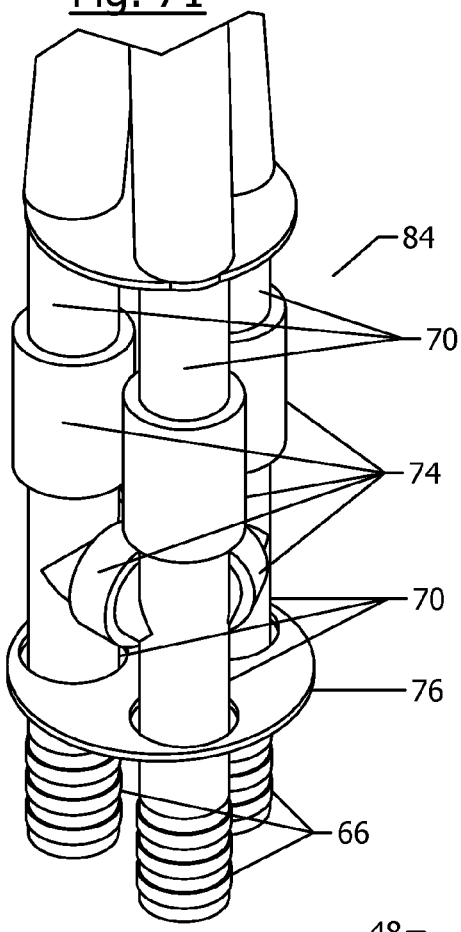
Fig. 72
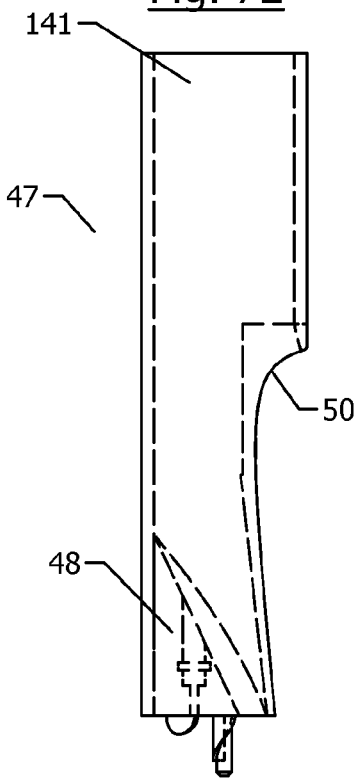
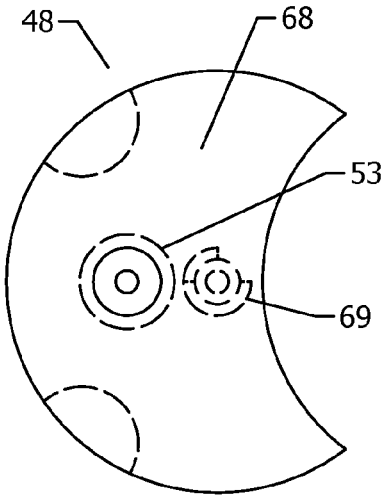
Fig. 73
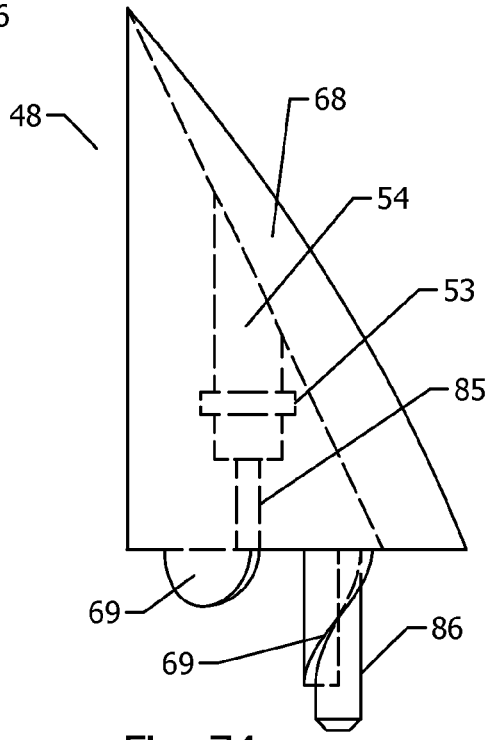
Fig. 74

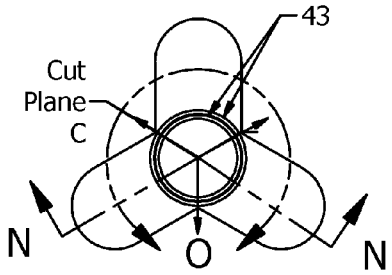
Fig. 75
Fig. 77
Section N-N
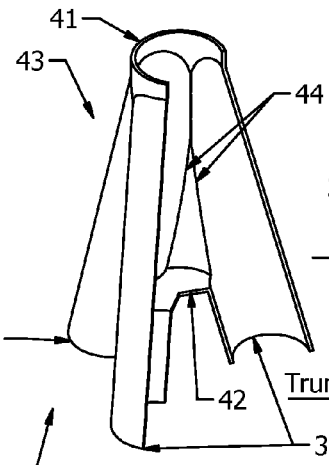
Fig. 78
Section N-N
& Max Dia. O
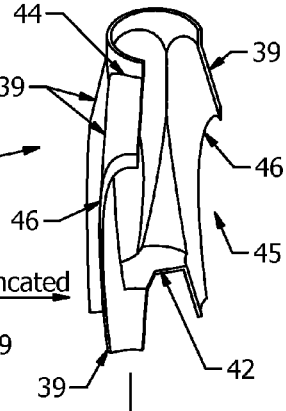
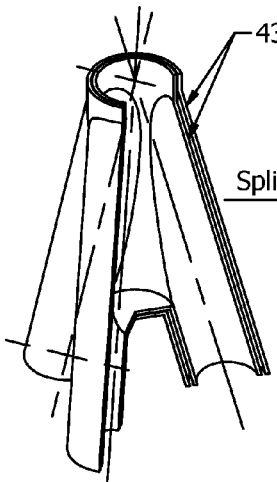
Fig. 76
Section N-N
Split
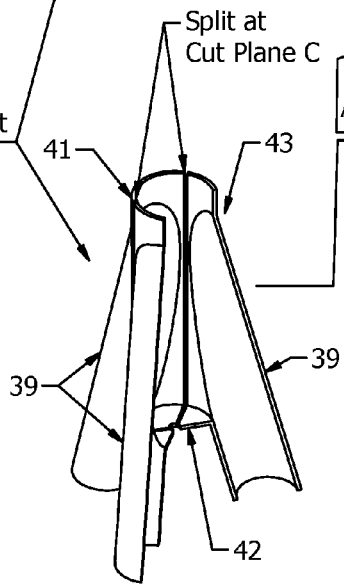
Fig. 79
Section N-N
& Cut Plane C
Assembled
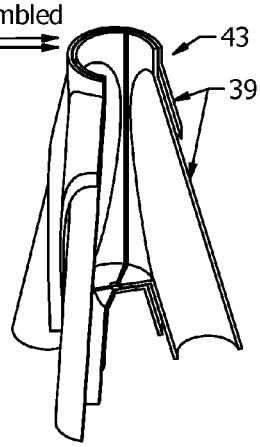
Fig. 80
Section N-N
& Max. Dai. O
& Cut Plane C Assembled
88
89
41
44
39
90
46
91
42
92
87
93
94
95
45
43

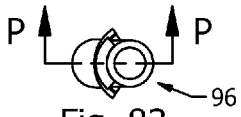
Fig. 83
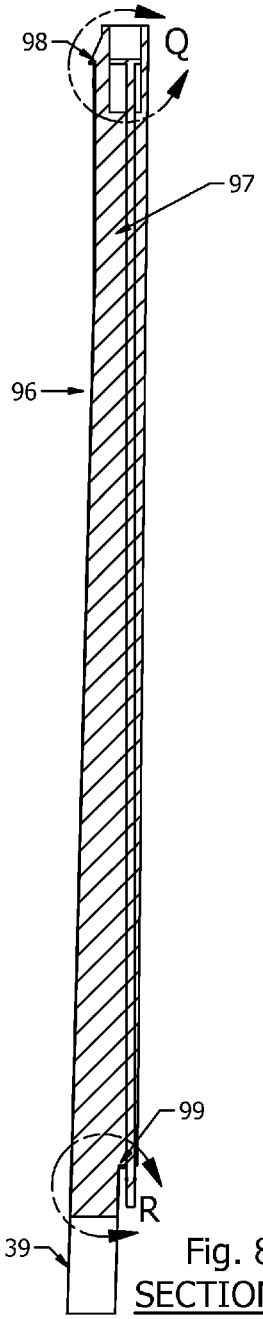
Fig. 84
SECTION P-P
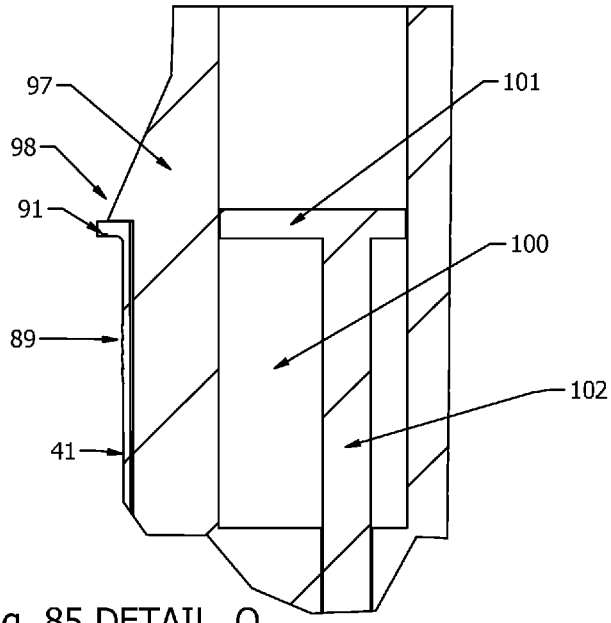
Fig. 85 DETAIL Q
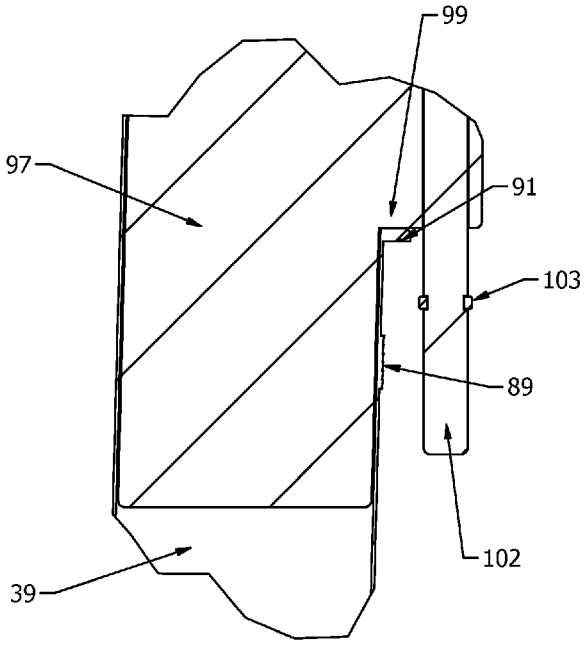
Fig. 86 DETAIL R

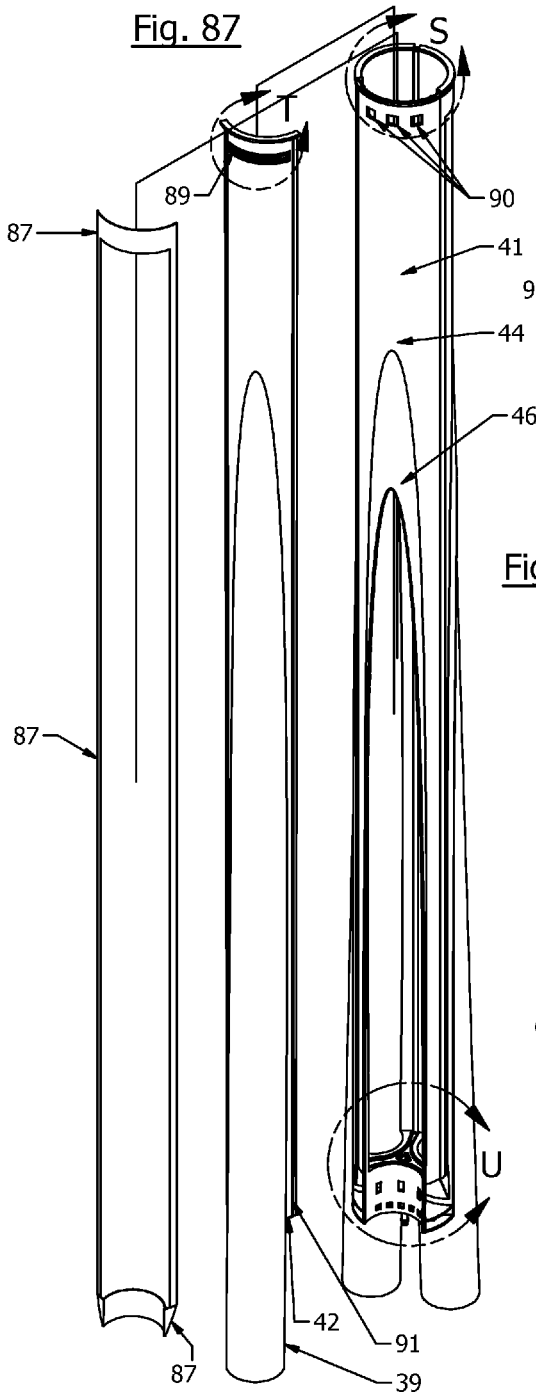
Fig. 87
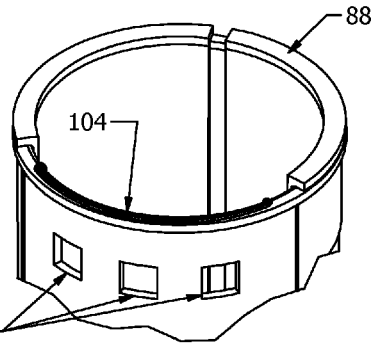
Fig. 88 DETAIL S
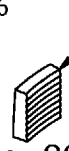
Fig. 89
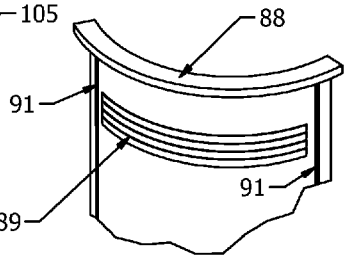
Fig. 90 DETAIL T
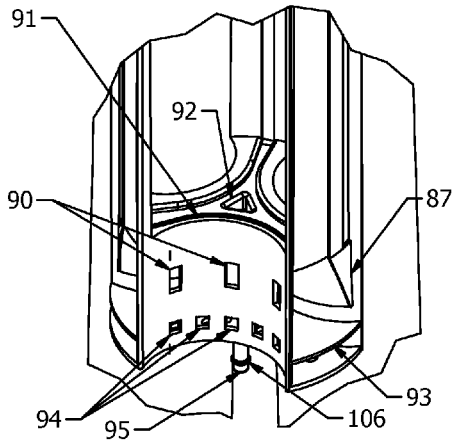
Fig. 91 Detail U Fig. 92
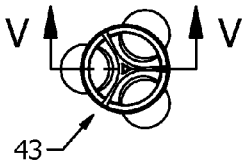
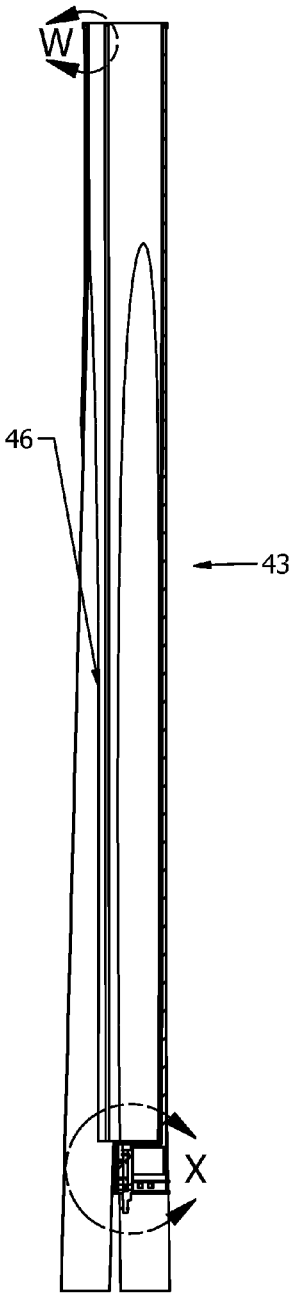
Fig. 93 Section V-V
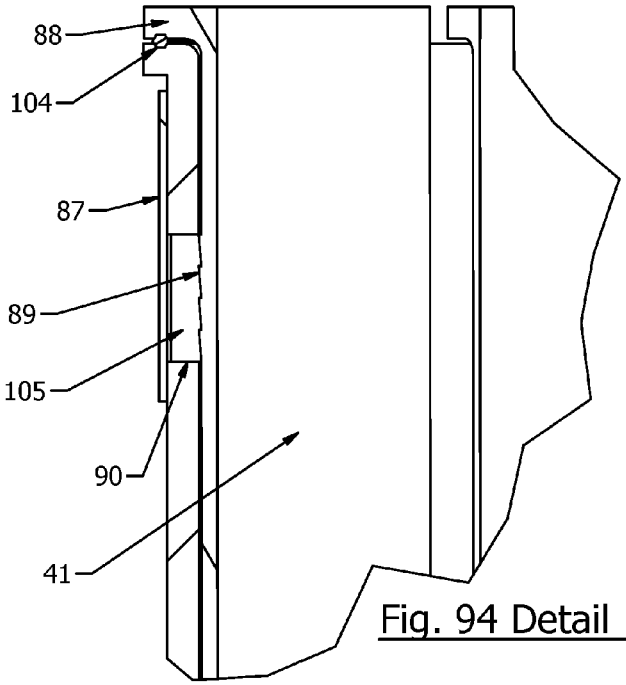
Fig. 94 Detail W
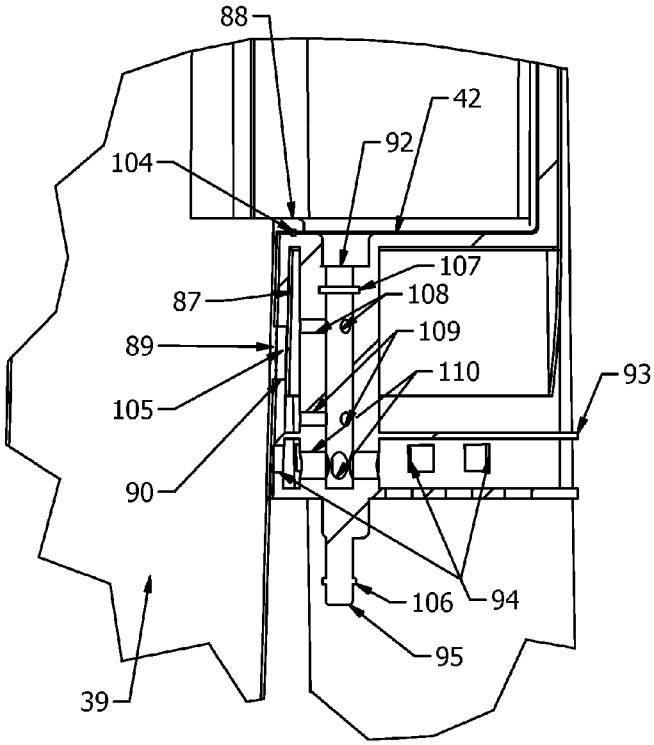
Fig. 95 Detail X Assembled

SYSTEMS AND METHODS FOR OPERATING A PLURALITY OF WELLS THROUGH A SINGLE BORE

CROSS-REFERENCE TO RELATED APPLICATIONS

The present application claims priority to the United Kingdom patent application having Patent Application Number 0910777.2, filed Jun. 23, 2009, the United Kingdom patent application having Patent Application Number 0902198.1, filed Feb. 11, 2009, and the United Kingdom patent application having Patent Application Number 0821352.2, filed Nov. 21, 2008, each of which are incorporated herein in their entirety by reference.

FIELD

The present invention relates, generally, to systems and methods usable to perform operations on a plurality of wells through a single main bore having one or more conduits within, including batch drilling and completion operations.

BACKGROUND

Conventional methods for performing operations on multiple wells within a region require numerous bores and conduits, coupled with associated valve trees, wellheads, and other equipment. Typically, above-ground conduits or above mudline-conduits and related pieces of production and/or injection equipment are used to communicate with each well. As a result, performing drilling, completion, and other similar operations within a region having numerous wells can be extremely costly and time-consuming, as it is often necessary to install above-ground or above-mudline equipment to interact with each well, or to erect a rig, then after use, disassemble, jack down and/or retrieve anchors, and move the rig to each successive well.

Significant hazards and costs exist for performing these same drilling, completion, and other similar operations for numerous wells, and the hazards and costs increase in harsh environments, such as those beneath the surface of the ocean, arctic regions, or situations in which space is limited, such as when operating from an offshore platform or artificial island. Additionally, the cost of above-ground or above-mudline valve trees and related equipment can be economically disadvantageous, and the use of such above-ground or above-mudline equipment can be subject to numerous environmental or other industry regulations that limit the number of wells, due to significant negative environmental impact.

A need exists for systems and methods usable to produce and/or inject through a plurality of independent well bores and/or perform other operations on multiple wells in a region through a single main bore.

A further need exists for systems and methods usable to operate on multiple wells through a single main bore, including laterally spaced wells within a region, in excess of distances achievable using conventional multilateral branches, having batch operations capabilities across a plurality of wells without requiring movement of the rig.

A need also exists for systems and methods to produce and/or inject through a plurality of wells within a region, usable within near surface strata, to minimize surface based equipment and the costs and negative environmental impacts associated therewith.

The present invention meets these needs.

BRIEF DESCRIPTION OF THE DRAWINGS

In the detailed description of various embodiments of the present invention presented below, reference is made to the accompanying drawings, in which:

FIG. 1 depicts a diagram of a prior art embodiment of multilateral well bores beneath an offshore drilling rig.

FIG. 2 depicts a prior art arrangement of multiple onshore valve trees within a region.

FIG. 2A depicts a cross-sectional elevation view of an embodiment of the present system that includes a riser is connected to a wellhead housing that is connected to the conductor casing chamber, which communicates with multiple well bores below.

FIG. 2B depicts a cross-sectional view of an embodiment of the present system in which a subsea wellhead connector and environmental riser for taking fluids to the surface are attached to a subsea wellhead with an attached differential pressure containment chamber engaged with a conductor casing chamber.

FIG. 18 depicts a top plan view of an embodiment of a double-walled chamber junction.

FIG. 19 depicts a cross-sectional view of the chamber junction of FIG. 18 along line E-E.

FIG. 20 depicts a bottom plan view of the chamber junction of FIG. 18.

FIG. 21 depicts an isometric view of the cross section shown in FIG. 19.

FIG. 22 depicts a top plan view of an embodiment of a bore selection tool usable with the chamber junction of FIG. 18.

FIG. 23 depicts a cross-sectional view of the bore selection tool of FIG. 22 a long line F-F.

FIG. 24 depicts an isometric view of the cross sections of FIGS. 19 and 23, showing the bore selection tool disposed within the chamber junction.

FIG. 25 depicts a top plan view of an alternate embodiment of a double walled chamber junction.

FIG. 26 depicts a cross-sectional view of the chamber junction of FIG. 25 along line G-G.

FIG. 27 depicts a bottom plan view of the chamber junction of FIG. 25.

FIG. 28 depicts an isometric view of the cross section shown in FIG. 26.

FIG. 29 depicts an isometric cross-sectional view of the chamber junction of FIG. 25 engaged with an additional double walled chamber junction.

FIG. 30 depicts a top plan view of an embodiment of a bore selection tool usable for insertion into the chamber junction of FIG. 25.

FIG. 31 depicts a cross-sectional view of the bore selection tool of FIG. 30.

FIG. 32 depicts an isometric cross-sectional view of the chamber junction of FIG. 25 engaged with the bore selection tool of FIG. 30.

FIG. 33 depicts a top plan view of another embodiment of a series of chamber junctions.

FIG. 34 depicts a cross-sectional view of the chamber junctions of FIG. 33 along line I-I.

FIG. 35 depicts an isometric view of the cross section of FIG. 31, depicting a bore selection tool.

FIG. 36 depicts an isometric view of the cross section of FIG. 34, depicting a series of chamber junctions.

FIG. 37 depicts an isometric view of the cross section of FIG. 23, depicting a bore selection tool.

FIG. 38 depicts an isometric view of the cross sections of FIGS. 31 and 34, depicting the bore selection tool of FIG. 31 disposed within the chamber junction of FIG. 34.

FIG. 39 depicts an isometric view of the cross sections of FIGS. 34 and 37, depicting the bore selection tool of FIG. 37 disposed within the chamber junction of FIG. 34.

FIG. 47 depicts an elevation isometric view of an embodiment of a bore selection tool.

FIG. 48 depicts an elevation isometric view of an embodiment of a chamber junction with an outer wall encircling conduits in communication with the additional orifices FIGS. 49-50 depict isometric plan views of an embodiment of a chamber junction usable with the bore selection tool of FIG. 47.

FIG. 51 depicts the bore selection tool of FIG. 47 inserted within the chamber junction of FIG. 48.

FIG. 58 depicts a top plan view of an embodiment of a double walled chamber junction with multiple conduit orifices contained within an outermost orifice.

FIG. 59 depicts a cross-sectional view of the chamber junction of FIG. 58 along line J-J.

FIG. 60 depicts a top plan view of a bore selection tool usable with the chamber junction of FIG. 58.

FIG. 61 depicts a cross-sectional view of the bore selection tool of FIG. 60 along line K-K.

FIG. 62 depicts an isometric cross-sectional view of the bore selection tool of FIG. 60 inserted within the chamber junction of FIG. 58.

FIG. 63 depicts a top plan view of an embodiment of a double walled chamber junction with a conduit having a plurality of additional orifices and a conduit having a single additional orifice within an outermost orifice.

FIG. 64 depicts an isometric view of a bore selection tool usable with the chamber junction of FIG. 63.

FIG. 65 depicts a sectional view of the chamber junction of FIG. 63 along line L-L.

FIG. 66 depicts the sectional view of the chamber junction of FIG. 65 with the bore selection tool of FIG. 64 inserted therein.

FIG. 67 depicts an isometric view of an embodiment of a chamber junction having secured valves for controlling communication between the chamber and conduits, with an installation apparatus for insertion into well bores or other chamber junctions.

FIG. 68 depicts an alternate embodiment of the chamber junction of FIG. 67 having an alternative configuration replacing the upper end along line M-M.

FIG. 69 depicts a top plan view of the chamber junction of FIG. 68.

FIG. 70 depicts a top plan view of an alternate embodiment of a chamber junction having a wear protection apparatus.

FIG. 71 depicts an isometric elevation view of a portion of the chamber junction of FIG. 67 with the addition of cross-over communication between conduits to create a by-pass manifold.

FIG. 72 depicts an elevation view of a bore selection tool usable with the chamber junction of FIG. 70.

FIG. 73 depicts a partial plan view of the bore selector of FIG. 72.

FIG. 74 depicts an elevation view of the partial bore selection tool of FIG. 73.

FIG. 75 depicts a top plan view of an embodiment of a multi-part chamber junction prior to performing the method of installation depicted in FIG. 12 through FIG. 15.

FIG. 76 depicts a partial isometric view along line N-N, depicting portions of the smaller chamber junction of FIG. 75 contained within the larger chamber junction.

FIG. 77 depicts a partial isometric view of portions of the larger chamber junction of FIG. 76.

FIG. 78 depicts a partial view of the isometric sectional view of the larger chamber junction of FIG. 77, within line O.

FIG. 79 depicts an isometric sectional view of a portion of the smaller chamber junction of FIG. 76, with the chamber separated along line C between the conduits of the additional orifices FIG. 80 depicts an isometric sectional view of the multi-part chamber junction created by sequentially inserting and securing the smaller chamber parts of FIG. 79 into the larger chamber junction of FIG. 78.

FIG. 83 depicts a top plan view of a securing tool usable to secure a multi-part chamber junction.

FIG. 84 depicts a cross-sectional view of the securing tool of FIG. 83 along line P-P.

FIGS. 85 and 86 depict magnified views of portions of the securing tool of FIG. 84 within lines Q and R, respectively.

FIG. 87 depicts an isometric view of an embodiment of a multi-part chamber junction including securing apparatuses.

FIGS. 88-91 depict magnified views of portions of the chamber junction of FIG. 87, with FIGS. 88, 90, and 91 depicting the portions of FIG. 87 within lines S, T, and U, respectively, and FIG. 89 depicting an embodiment of a securing apparatus usable with the chamber junction of FIG. 87.

FIG. 92 depicts a top plan view of an embodiment of a chamber junction.

FIG. 93 depicts a cross-sectional view of the chamber junction of FIG. 92 along line V-V.

FIGS. 94 and 95 depict magnified views of portions of the chamber junction of FIG. 93, within lines W and X, respectively.

Figures 3, 4, 5, 6, 7:
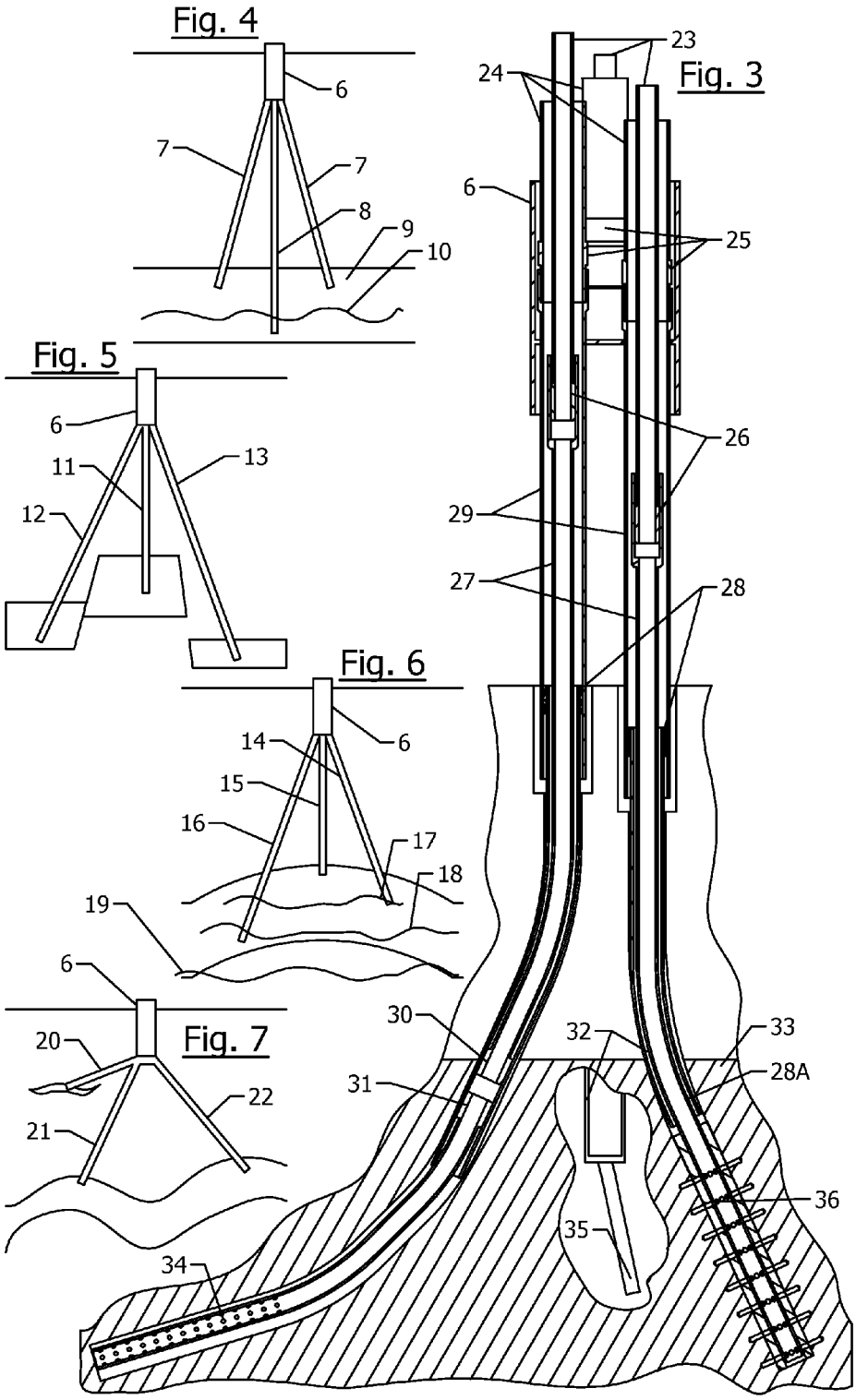

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

The present invention relates, generally, to systems and methods usable to produce, inject, and/or perform operations on a plurality of wells, including multiple, laterally spaced wells, through a single main bore. To provide access to each of a desired selection of wells, one or more chamber junctions are provided in fluid communication with one or more conduits within the single main bore. The chamber junction is a construction having a chamber and plurality of orifices that intersect the chamber. A first of the orifices is used to communicate with the surface through subterranean strata, via one or more conduits within the main bore, while one or more additional orifices within the chamber junction are usable to communicate with any number of well bores through associated conduits. Thus, a chamber junction can have any shape or arrangement of orifices necessary to engage a desired configuration of conduits.

Any number and any arrangement of chamber junctions and/or communicating conduits can be inserted or urged through the single main bore and assembled, in series or in parallel, to accommodate any configuration of wells. Chamber junctions and conduits can also be assembled concentrically or eccentrically about one another, which both defines annuli usable to flow substances into or from selected wells, and provides multiple barriers between the surrounding environment and the interior of the chambers and conduits. A composite structure is thereby formed, which can include any number of communicating or separated conduits and chambers, with or without annuli, each conduit and/or annulus usable to communicate substances into or from a selected well.

Each of the wells can be individually or simultaneously accessed, produced, injected, and/or otherwise operated upon by inserting a bore selection tool into the chamber junction. The bore selection tool can include an exterior wall, an upper opening that is aligned with the first orifice when inserted, and one or more lower openings, each aligned with an additional orifice of the chamber junction to enable communication with the associated well bores. Use of a bore selection tool enables selective isolation and/or communication with individual wells or groups of wells, for performing various operations, including drilling, completion, intervention operations, and other similar undertakings. Required tools and equipment, drilling bottom hole assemblies, coiled tubing, wire line bottom hole assemblies, and similar items for performing an operation on a selected well bore can be lowered through the conduit, into the upper opening of the bore selection tool disposed within the chamber junction, then guided by the bore selection tool through a lower opening in the bore selection tool to enter the selected well bore. In one or more embodiments of the invention, the arrangement of the orifices within each chamber junction, can cause certain orifices to have an incomplete circumference. In such an embodiment, the bore selection tool can include an extension member sized and shaped for passage into one of the orifices, such that the extension member completes the circumference of the selected orifice when the bore selection tool is properly inserted and oriented, thereby enabling communication with the respective well through the orifice while isolating other orifices.

By providing selective access to a plurality of well bores through a single main composite bore, the present systems and methods provide greater efficiency and reduced expense over existing methods by reducing above-ground equipment requirements and reducing or eliminating the need to move, erect, and disassemble drilling rigs and similar equipment.

Conventional methods for reducing the number of conduits and the quantity of above-ground equipment used to produce or otherwise operate on a well are generally limited, the most common of such methods being the drilling of multilateral wells, which include multiple dependent bores drilled in a generally lateral direction from a central, main bore. Various embodiments of multilateral well technology are described in U.S. Pat. No. 5,564,503, the entirety of which is incorporated herein by reference. FIG. 1 depicts an exemplary embodiment of a multilateral configuration, which includes an offshore drilling rig (1) having multiple lateral well bores branching from a main well bore. Various types of lateral well bores are depicted, including unsealed junctions (2), an unsealed series of fish-bone multilateral junctions (3), and mechanically sealed junctions (4), each branching from a single main bore.

To avoid the risk of collapse, lateral completion is typically only usable within competent rock formations, and the ability to access or re-enter the lateral well bore is limited, as is the ability to isolate production zones within the well bore. Further, lateral well bores are limited in their use and placement, being unsuitable for use within surface and near-surface regions of strata due to their generally open-hole construction.

The alternative to multilateral wells and similar methods includes the unrestricted spacing of single well bores within a region. FIG. 2 depicts numerous onshore surface production trees (5) spaced from one another to produce a subterranean reservoir through multiple well bores, each surface production tree (5) usable to access a single well bore. Use of this unrestricted method is suitable only when the quantity of space occupied by production equipment is not an economic or environmental concern, and when the complexity of the production operations is low.

The present systems and methods overcome the limitations of the conventional approaches described above, and are usable to operate on any type or combination of wells, individually or simultaneously, including but not limited to producing hydrocarbons or geothermal energy, injecting water or lift gas to facilitate production, disposing of waste water or other waste substances into a waste well, injecting gas for pressure maintenance within a well or gas storage within a storage well, or combinations thereof. Further, the present systems and methods provide the ability to access each well, simultaneously or individually, for any operations, including batch completion operations, batch drilling operations, production, injection, waste disposal, or other similar operations, while preventing the migration and/or contamination of fluids or other materials between well bores and/or the environment.

Additionally, any number of valves, manifolds, other similar equipment, or combinations thereof, can be disposed in communication with the chamber junction in a subterranean environment within the composite main bore. A single valve tree or similar apparatus can then be placed in communication with the upper end of the main bore, the valve tree being operable for communicating with any of the wells. Conventional systems for combining multiple well bore conduits within a single tree are generally limited to above ground use, consuming surface space that can be limited and/or costly in certain applications. Additionally, unlike above-ground conventional systems, embodiments of the present system are usable in both above ground applications and subsea applications to reduce the quantity of costly manifolds and facilities required.

The present invention also relates to a method for providing communication with a plurality of wells through formation of chamber junctions. A plurality of conduits, which can include concentric conduits, can be provided and arranged, such that the upper end of each conduit is generally proximate to that of each other conduit. One or more main conduits, having an open upper end and a closed lower end, can then be provided, such that the upper ends of the plurality of conduits are enclosed by a main conduit. Material from the conduits, which can include portions of the main conduit, can be removed to form additional orifices for communication with one or more wells. Similarly, material from the main conduit, which can include portions of the conduits used to form the additional orifices, can be removed to define a chamber, with each of the conduits intersecting the chamber at one of the additional orifices. A bore selection tool with an upper orifice corresponding to the chamber upper end and one or more lower orifices corresponding to one or more of the additional orifices can be inserted into the chamber for providing access to one or more well bores through selected additional orifices while isolating other well bores.

The present systems and methods thereby provide the ability to produce, inject, and/or perform other operations on any number of wells within a region, through one or more conduits within a single bore, while enabling selective isolation and selective access to any individual well or combinations of wells. A minimum of surface equipment is required to access and control operations for each of the wells placed in communication with the chamber junction, a single valve tree being sufficient to communicate with each well through one or more conduits within the single bore.

Figures 40, 41, 42, 43, 44, 45, 46:
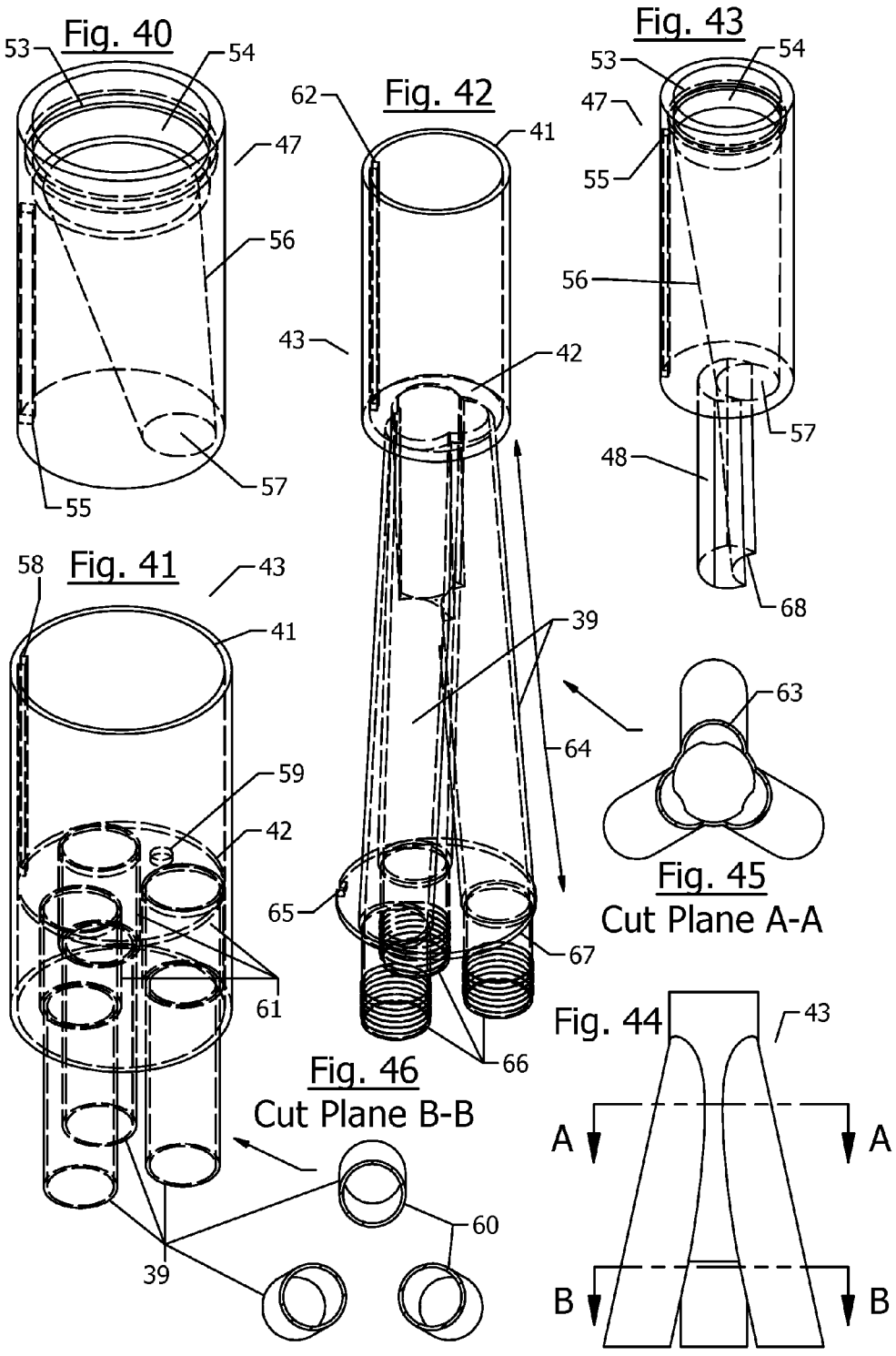
FIG. 40 depicts an isometric view of an embodiment of a bore selection tool usable for insertion into the chamber junction of FIG. 41.
FIG. 41 depicts an isometric view of an embodiment of a chamber junction secured to the upper end of conduits, such as those depicted in FIG. 3.
FIG. 42 depicts an isometric view an embodiment of a chamber junction usable for insertion into the chamber junction of FIG. 41 to create a series of chamber junctions.
FIG. 43 depicts an isometric view of an embodiment of a bore selection tool usable for insertion into the chamber junction of FIG. 42.
FIG. 44 depicts a diagrammatic elevation plan view illustrating an embodiment of a method for configuring additional orifices to respective chambers in the chamber junctions of FIGS. 41 and 42.
FIG. 45 depicts a partial diagrammatic view of the chamber junction of FIG. 44 along line A-A illustrating the shape of the interface between the chamber and the additional orifices.
FIG. 46 depicts a partial diagrammatic view of the chamber junction of FIG. 44 along line B-B illustrating the shape of the interface between the chamber and the additional orifices.

Referring now to FIG. 3, a cross-sectional view of multiple, laterally separated well bores is shown, engaged with an embodiment of the present system, such as those depicted in FIGS. 41, 42, and 67. A composite main bore (6) is depicted, secured to an intermediate casing or conduit (29) below, which is shown in communication with three laterally separated well bores within a reservoir (33). Tubing conduits (23) communicate between the composite main bore (6) and each laterally separated well bore through intermediate conduits (27).

The first well bore is shown including sand screens (34) for near horizontal sand screen completion. The sand screens (34) and tubing conduit are placed in an unsupported or gravel-packed subterranean bore and tied back with tubing using a packer (31) to a liner or casing. An upper completion tubing conduit (27) with a second packer (30) at its bottom communicates with the well bore and is tied back to a polished bore receptacle and mandrel seal stack (26), which is secured to the tubing conduit (23) extending through the composite main bore (6).

Referring now to FIG. 2A, an exemplary embodiment of the present system is depicted in which an environmental Riser (125) used for taking returns to the surface during subsea drilling operations is connected with and used to run a wellhead housing (124), which in turn is connected to a permanent guide base (122) with subsea posts (123) to facilitate guidelines to surface.

In the depicted embodiment, a bore hole capable of accepting a conductor casing chamber (43) or chamber junction can be urged axially downwards with the conductor casing chamber (43) attached to the wellhead housing (124), permanent guide base (122), and subsea posts (123), such that multiple components can be run as a single unit and cemented in place (121).

It should be noted that FIG. 2A depicts a single exemplary embodiment and that other embodiments of the present system can include the use of a wellhead housing (124) and conductor casing chamber (43).

The conductor casing chamber (43) attached to the wellhead housing (124) includes a guide template (113) to accept intermediate casing (115) with polished bore receptacles (112) at the top of each intermediate casing (115).

To facilitate formation of an outer differential pressure barrier for the inclusion of gas lift or other stimulation measures, the space between the subterranean formation, conductor casing chamber (43), guide template (113), and intermediate casing (115) can be grouted (114) using a stab-in connector (not shown in FIG. 2A). In this manner, a differential pressure containment envelope is created around any equipment installed within, which provides a final barrier against escape of fluids, gas, or vapors from the inner most tubing.

Referring now to FIG. 2B, an exemplary embodiment of the present system is depicted in which a subsea wellhead connector (116) and environmental riser for taking fluids to the surface, are attached to a subsea wellhead (117) with a differential pressure containment chamber (43) or chamber junction attached below the subsea wellhead (117). Other embodiments of the present system can also include use of a wellhead and chamber assembly, similar to the depicted embodiment in an above sea level offshore or an onshore environment.

The differential pressure containment chamber (43), with connectors and polished bore receptacle (PBR) mandrels attached below using inclined connectors (120), is run axially downward and plugged into the polished bore receptacles (112), attached to the intermediate casing (115) to form a differential pressure control barrier for preventing the escape of fluids, gas, or vapors, from the production or injection tubing, wherein the annulus pressure between the chamber junction (41 of FIG. 2A) and chamber junction (41 of FIG. 2B) may be made positive or negative. In above sea level applications the annulus pressure may be made positive, negative or generally equal to atmospheric pressure. Inclusion of a negatively pressured annulus providing thermal insulation has benefits in high temperature wells, artic wells through permafrost, and other environmentally sensitive environments where the differential pressure containment chamber (43) or chamber junction may be used to reduce both thermal radiation and the number of wells radiating subterranean heat or cold from gas expansion in gas storage wells.

FIG. 7 depicts the lower end of the composite main bore (6) engaged with a first well bore (21) to a geologic feature, a laterally separated well bore (22) to a region of the geologic feature that could not be effectively drained using the first well bore (21), and an additional well bore (20) that communicates with a separate subterranean feature for storage or waste disposal.

Referring now to FIGS. 8 through 13, embodiments of stages of a method usable to construct a chamber junction for communication between the composite main bore and multiple well bores are depicted, in successive stages of construction.

Figures 8, 9, 10, 11, 12, 13, 14, 15, 16, 17:
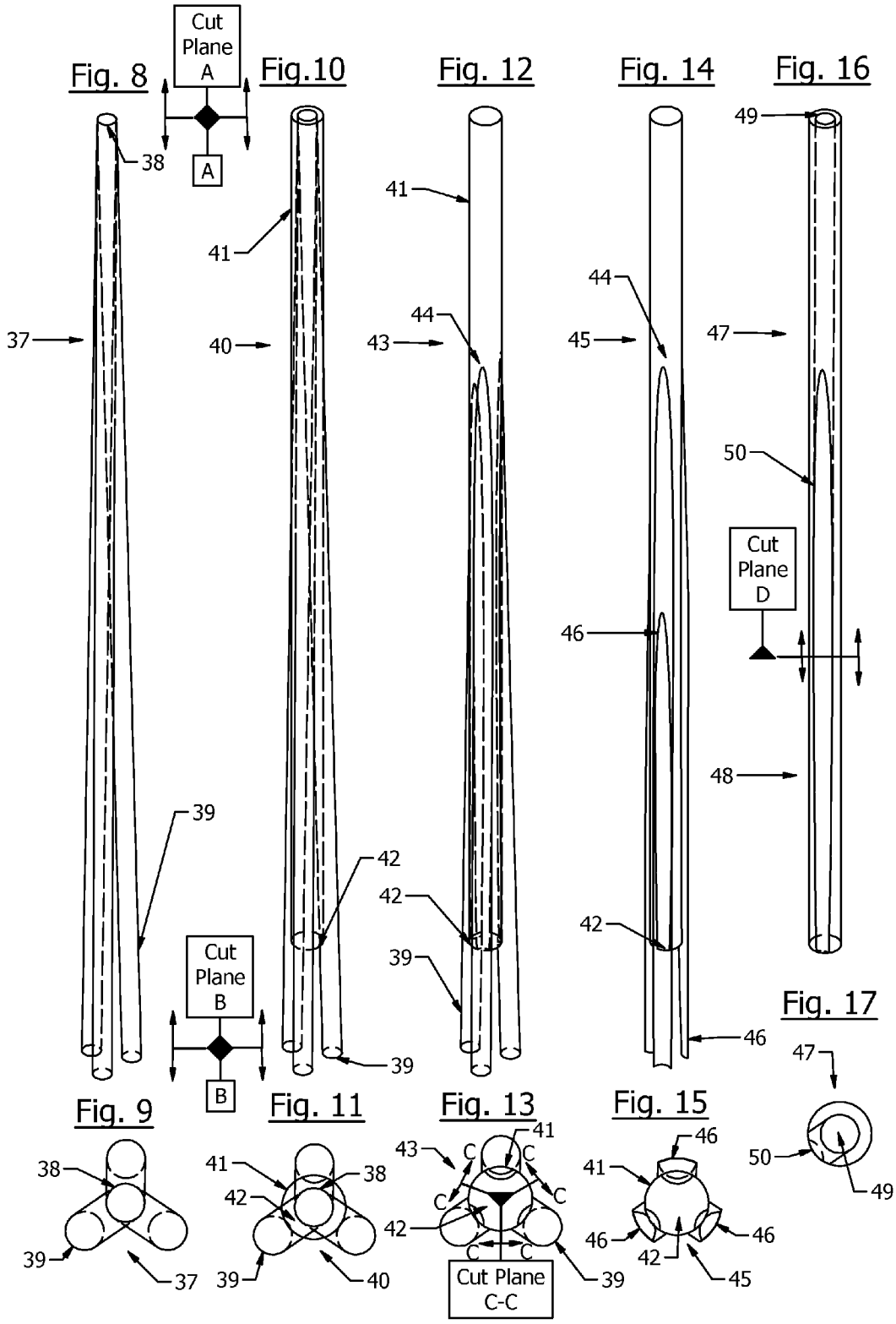
FIGS. 8-17 depict an embodiment of a multi-part chamber junction of the present system during various stages of providing communication with a plurality of well bores through formation of the chamber junction and segregating the chamber junction into installable parts with an associated bore selector, with FIGS. 8, 10, 12, 14, and 16 depicting elevational isometric views of the chamber junction and bore selector, and FIGS. 9, 11, 13, 15, and 17 depicting plan views of FIGS. 8, 10, 12, 14, and 16, respectively.

FIG. 8 depicts an elevation isometric view, and FIG. 9 depicts a top plan view, of a partial chamber junction (37), having overlapping projections of additional orifices converging, or proximate, to the diameter of a first orifice (38), corresponding to cut plane A-A, usable to communicate with a conduit within the single main bore, and additional orifice conduits (39) with lower ends corresponding to cut plane B-B, usable to communicate with differing well bores. The centerlines of each additional orifice conduit (39) are separated at the base of the partial chamber junction (37), but converge at or proximate to the first orifice (38), enabling alignment and access to each additional orifice (39) when a bore selection tool is placed within the first orifice.

FIG. 10 depicts an elevation isometric view, and FIG. 11 a plan view, of an assembled chamber junction (40), having a conduit disposed about the partial chamber junction (37, depicted in FIG. 8), defining a chamber (41) above each of the additional orifice conduits (39). The conduit is shown having an open cavity at its upper end (referred to as the first orifice, walls penetrated only by the inner diameter of the additional orifice conduits (39), and a closed bottom (42) to define the chamber (41).

FIG. 12 depicts an elevation isometric view, and FIG. 13 a plan view, of a completed chamber junction (43), with a conduit, having a first orifice at its upper end and all material removed from the internal diameter of the additional orifice conduits (39), creating usable additional orifices extending from the chamber (41). The additional orifice conduits (39) are shown meeting and commingling at a securing point (44) within the chamber (41).

Extending the length of the additional orifice conduits (39) enables the central axis of the additional orifice conduits (39) to have a low angle of divergence from the central axis of the chamber (41), which aids passage of various tools and apparatuses through a bore selection tool inserted into the chamber (41) of the chamber junction (43) and into additional orifice conduits (39). In various embodiments of the invention, to maintain small angular deflections from vertical within the chamber junction (43), long chamber junctions can be utilized. Long chamber junctions can be split into parts sized for insertion into a subterranean bore.

As shown in FIGS. 8 and 10, cut planes A-A and B-B demonstrate potential split planes for a chamber junction perpendicular to its central axis for facilitating unitization and insertion of the chamber junction into subterranean strata. Cut plane A-A illustrates the upper end of overlapping projections of additional orifices along their central axis, converging or proximate to the diameter of the first orifice (38), and is axially above cut plane B-B, which illustrates the lower end of the additional orifice projections. It should be noted that the position of cut planes A-A and B-B are exemplary, and that the any number of cut planes can be positioned anywhere along the central axis of the converging projections. The depicted chamber junction (43) is thereby defined by the additional orifice conduits (39) and the angular orientation between the cut planes A-A and B-B, wherein the conduits are secured to a chamber (41) having a first orifice at its upper end, a closed lower end (42), and an open cavity capable of accepting a bore selection tool, with chamber walls having communicating passageways to the internal diameters of the additional orifice conduits (39).

FIG. 13 depicts cut plane C-C-C, which demonstrates split planes for a chamber junction through its central axis, whereby a smaller unitized or split chamber junction, such as that shown in FIGS. 12 and 13 can be unitized, inserted into and secured to a larger partial chamber junction, such as that depicted in FIGS. 14 and 15, to facilitate downhole construction of a unitized chamber junction when the diameter of the main bore limits the size of apparatuses that can be inserted therein.

Referring now to FIGS. 14 and 15, FIG. 14 depicts an elevated isometric view, and FIG. 15 a plan view, of a partial chamber junction (45), with a chamber having a closed lower end (42), with the additional orifice conduits (39) having portions removed external to a maximum outside diameter, joined with the chamber at securing points (44), to accommodate downhole construction of a chamber junction through a bore having a limited maximum diameter. Additional portions of a chamber junction, such as those formed by cutting the chamber junction (43) of FIG. 13 along cut plane C-C-C can be inserted into the partial chamber junction (45) to form a complete chamber junction.

Referring now to FIGS. 16 and 17, an elevation isometric view and a plan view, respectively, of an embodiment of a bore selection tool usable within the chamber junction (43) of FIG. 12 is shown. The bore selection tool (47) is shown having an internal bore (49) extending therethrough, terminating at a lower orifice (50), which aligns with an additional orifice of the chamber junction when the bore selection tool (47) is inserted into the chamber therein. Similarly, the upper opening of the internal bore (49) coincides approximately with the first orifice of the chamber junction when the bore selection tool (47) is inserted. The lower end of the bore selection tool (47) can be unitized into an extension member (48) using cut plane D-D, which coincides with cut plane A-A and is relative to the internal bore (49), the extension member (48) being sized and configured to complete the circumference of the additional orifice conduit (39) aligned with the internal bore (49), within the chamber of the chamber junction. In instances where an extension member (48) formed at the lower end of a bore selection tool is inserted into a chamber, the upper end of the bore selection tool can protrude outside of the chamber, extending into the conduit engaged with the upper end of the chamber.

Referring now to FIGS. 18-21, a junction of wells (51) is depicted, at which a plurality of wells can selectively be permitted to comingle. The junction of wells (51) is defined by a multi-part or double walled chamber junction, which is depicted including two individual chamber junctions (43) concentrically disposed about one another, each defining a chamber (41) within. Additional orifice conduits (39) extend therefrom, which are shown as double-walled concentric conduits. The resulting double-walled structure, defining an annular space, provides two barrier walls and isolation between the innermost cavities of the conduits and the subterranean environment in which they are contained.

FIG. 19 depicts a cross-sectional view of the junction of wells (51) shown in FIG. 18, along line E-E, which more clearly depicts a smaller chamber junction disposed within a larger chamber junction. The chambers (41) and additional orifice conduits (39) of the chamber junctions (43) are shown secured together at a securing point (44), proximate to the closed chamber bottom (42) and walls of the chamber junctions (43), such that the bottom of each chamber junction is generally parallel. The centerline of the chamber (41) and that of each additional orifice conduit (39) are shown crossing at a junction point (52), where the communicating passageways from each additional orifice conduit (39) comingle within the chamber (41) or conduit engaged at the upper end of the chamber (41), unless isolated using a bore selection tool or other isolation devices. FIG. 20 depicts a bottom plan view of the junction of wells (51), which more clearly depicts the concentric additional orifice conduits (39), secured to the chamber (41) at the securing points (44) proximate to the bottom (42) and walls of the chamber (41).

Referring now to FIGS. 22 and 23, an embodiment of a bore selection tool usable with the chamber junction of FIGS. 18-21 is shown. The bore selection tool (47) is depicted as a tubular member sized for insertion within the upper orifice of the chamber (41) of the innermost chamber junction, the bore selection tool (47) having an internal bore (49), which extends through the body of the bore selection tool (47) at an angle, to terminate at a selection bore (50). The internal bore (49) can be concentric, eccentric, tapered, angled, straight, or have any other desired shape or angle, depending on the orientation of the additional orifice conduit to be isolated in relation to the upper orifice of the chamber junction. Additional orientation and/or guidance apparatuses can also be engaged with the upper end of a bore selection tool and/or an extension member, as described previously, with the upper end of the extension defined by cut plain D-D, such that an additional apparatus resides within the conduit engaged to the upper end of the chamber of a chamber junction.

FIG. 24 depicts an isometric cross-sectional view of the chamber junction of FIGS. 18-21 having the bore selection tool of FIGS. 22 and 23 inserted therein. The upper portion of the internal bore (49) is shown in alignment with the upper orifice of the chamber junction, within the chamber (41), while the selection bore (50) of the bore selection tool (47) is oriented to align with one of the additional orifice conduits (39) of the chamber junction. It should be noted that when the depicted bore selection tool (47) enables access to an individual selected additional orifice conduit (39), each other additional orifice conduit is isolated by the exterior surface of the bore selection tool (47).

Referring now to FIGS. 25 through 28, an alternate embodiment of a multi-part chamber junction is depicted, having two concentric chamber junctions (43), with two concentric additional orifice conduits (39), the first extending generally downward opposite the upper first orifice, and the second extending at an angle from the central axis of the chamber (41), the depicted structure defining a junction of wells (51). As described previously, the concentric chamber junctions (43) are secured at securing point (44) proximate to the bottom (42) and walls of each chamber (41) of each chamber junction (43). The centerlines of each additional orifice conduit (39) and the chamber (41) coincide at a junction point (52).

Referring now to FIG. 29, the chamber junction of FIGS. 25-28 is depicted, in a vertical engagement with a second chamber junction of similar construction. The second chamber junction is shown engaged with the lowermost additional orifice conduit of the first chamber junction, thereby providing a composite structure having one additional orifice conduit (39) vertically displaced from another, and a lower additional orifice conduit (39) extending in a generally downward direction, defining a junction of wells (51). Any number of chamber junctions having any configuration of additional orifices can be stacked or otherwise arranged in series and/or in parallel, enabling provision of additional orifice conduits oriented to engage well bores of varying configurations, rotationally or axially displaced from one another by any distance or angle.

Referring now to FIGS. 30 and 31, an embodiment of a bore selection tool is shown, the bore selection tool (47) having a generally tubular shape with an angled internal bore (49) at its upper end that terminates at a selection bore (50) along a side of the bore selection tool (47).

FIG. 32 depicts the bore selection tool (47) of FIGS. 30 and 31 engaged within the chamber junction (43) of FIGS. 25-28. As shown, when inserted within the first orifice at the upper end of the chamber junction, the selection bore (50) of the bore selection tool (47) aligns with an additional orifice of the chamber junction, enabling operations to be performed on the well that corresponds to the aligned additional orifice by passing tools, coiled tubing, and/or other similar objects through the internal bore (49) of the bore selection tool, while one or more other wells are isolated, after which the bore selection tool (47) can be removed to restore communication between all additional orifices and the first orifice.

Referring now to FIGS. 33, 34, and 36, a junction of wells (51) is depicted, defined by two stacked chamber junctions. The upper chamber junction is shown having two additional orifice conduits (39) a first extending generally downward opposite the upper first orifice, and a second extending outward at an angle from the side of the chamber junction, both additional orifice conduits (39) intersecting a chamber (41) at a securing point (44). The lower of the additional orifice conduits (39) is shown in communication with the second double walled chamber junction secured below. The lower chamber junction is shown having two additional orifice conduits (39), each extending outward at an angle proximate to the bottom of the lower chamber junction, similarly intersecting the chamber (41) at a securing point (44).

FIG. 35 depicts an embodiment of a bore selection tool (47), having an internal bore (49) that is angled through the body of the bore selection tool (47) such that the selection bore (50) at which the internal bore (49) terminates will be aligned with an additional orifice of the upper chamber junction of FIGS. 33, 34, and 36 when the bore selection tool (47) is inserted therein.

FIG. 38 depicts the junction of wells (51), having the bore selection tool of FIG. 35 inserted within the upper double walled chamber junction of FIGS. 33, 34, and 36, showing alignment between the selection bore (50) bore of the bore selection tool and the additional orifice of the upper double walled chamber junction.

FIG. 37 depicts an alternate embodiment of a bore selection tool (47), having an internal bore (49) that is angled through the body of the bore selection tool (47) such that the selection bore (50) at which the internal bore (49) terminates will be aligned with an additional orifice of the lower double walled chamber junction of FIGS. 33, 34, and 36, when the bore selection tool (47) is inserted therein.

FIG. 39 depicts the junction of wells (51), having the bore selection tool of FIG. 37 inserted within the lower chamber junction of FIGS. 33, 34, and 36, showing alignment between the selection bore (50) bore of the bore selection tool and one of the additional orifices of the lower chamber junction. In an embodiment of the invention, the lower end of the bore selection tool can include an extension member, as described previously, enabling additional apparatuses for guidance and/or orientation to be placed within the conduits and/or chamber junctions, such as through engagement to the upper end of the chamber of the innermost chamber junction.

As demonstrated in FIGS. 33-39, and in the preceding depicted and described embodiments, any combination and configuration of chamber junctions having additional orifices, and other communicating conduits, can be constructed concentrically, in series, and/or in parallel, to accommodate any desired well bore orientation, and any configuration of additional orifice conduits can be made accessible and/or isolated using one or more corresponding bore selection tools.

Embodiments of the present system can be installed by urging a subterranean bore into subterranean strata, then placing the lower end of a chamber junction at the lower end of the subterranean bore. A conduit is placed within the bore, its lower end connected to the upper end of the chamber junction. Sequentially, a series of additional subterranean bores can then be urged through one or more additional orifice conduits of the chamber junction, such as by performing drilling operations through the chamber junction and associated conduits. The upper ends of the conduits that extend within the additional subterranean bores can be secured to the lower ends of the additional orifice conduits. To sequentially access each additional orifice conduit when urging or interacting with additional subterranean bores extending to similar depths through similar geologic conditions, a bore selection tool, as described previously, can be inserted into the chamber junction to isolate one or more of the additional orifice conduits from one or more other additional orifice conduits, while facilitating access through the desired additional orifice for interacting with, urging axially downward and/or placing conduits or other apparatuses within the bores of the accessed well.

The drilling, completion, or intervention of a series of subterranean bores in this batch or sequential manner provides the benefit of accelerating application of knowledge gained before it becomes lost or degraded through conventional record keeping methods or replacement of personnel, as each of the series of bores will pass through the same relative geologic conditions of depth, formation, pressure, and temperature within a relatively condensed period of time compared to conventional methods, allowing each subsequent bore to be drilled, completed, or otherwise interacted with more efficiently.

Referring now to FIG. 41, an isometric view of an embodiment of a chamber junction (43) for placement at the lower end of a subterranean bore is depicted, having a chamber (41), with three additional orifice conduits (39) shown disposed proximate to the chamber bottom (42). Each additional orifice conduit (39) is depicted having a polished bore receptacle (61) or similar connector for connection with other apparatuses, such as mandrel seal stacks at the lower end of an additional chamber junction, such as that depicted in FIG. 42. A key or slot, (58) or similar internal protrusion or receptacle is shown, usable to engage with bore selection tools and/or other chamber junctions having a complementary protrusion or receptacle, to cause alignment and orientation of the objects engaged therewith. The chamber junction (43) is also shown having a circulating port (59) or bypass conduit, usable to flow fluid between the chamber (41) and the adjacent annulus, for removing cuttings, placing cement, and flowing fluids for similar operations. Once the chamber junction is placed and secured at the lower end of a subterranean bore, batch operations through the additional orifice conduits (39) can be performed, and the lower end of the chamber junction (43) can be engaged with the upper end of conduits communicating with wells, such as those depicted in FIG. 3, while the upper end of the chamber junction can be engaged with an upper conduit that communicates with the composite main bore.

FIG. 40 depicts a bore selection tool (47) usable for insertion into the chamber junction of FIG. 41. The bore selection tool (47) is shown having an index key or slot (55), which can engage with the key or slot of the chamber junction to orient the bore selection tool (47) within the chamber. The bore selection tool (47) is shown having an eccentric bore (56) with a lower end (57) that will align with one of the additional orifice conduits of the chamber junction of FIG. 41 when the bore selection tool (47) is inserted and oriented therein. The bore selection tool (47) is also shown having a cavity (54) and a groove (53) proximate to its upper end, for accommodating latching, locking, and/or securing with a tool usable to insert and retrieve the bore selection tool (47) from the chamber junction.

FIG. 42 depicts a smaller chamber junction (43), sized for insertion into the chamber junction of FIG. 41 to form a multi-part, double-walled structure. The depicted chamber junction (43) of FIG. 42 includes a chamber (41) with additional orifice conduits (39) extending a selected length (64) from the chamber bottom (42) to engage a lower plate (67). It should be noted that due to the position of the cut plane A-A, described in FIG. 8 and FIG. 10, applied to the depicted chamber junction (43), each of the additional orifice conduits (39) overlaps at their upper ends, such that each additional orifice conduit (39) has an incomplete circumference or cloverleaf shape at its upper end, such that an appropriately sized and shaped bore selection tool is usable to complete the circumference of a selected additional orifice conduit when isolating and accessing the additional orifice conduit.

FIG. 44 depicts an elevation diagrammatic view of a chamber junction (43). FIG. 45 depicts a cut view of the chamber junction of FIG. 44 along line A-A, depicting the cloverleaf shape (63) of the overlapping additional orifices having incomplete circumferences at their upper ends. FIG. 46 depicts a cut view of the chamber junction of FIG. 44 along line B-B, depicting the separation between the circumferences at the lower end of the additional orifice conduits (60). The selected length (64) of the additional orifice conduits can be represented by the distance between cut plane A-A and cut plane B-B.

Returning to FIG. 42, mandrel seal stacks (66) are shown engaged with the lower end of each of the additional orifice conduits (39). When the chamber junction (43) of FIG. 42 is engaged with the chamber junction of FIG. 41, the mandrel seal stacks (66) can be secured within the polished bore receptacles (61, depicted in FIG. 41), while the lower plate (67) can abut or be positioned proximate to the bottom of the chamber of the larger chamber junction. The lower plate (67) is shown having a slot or key (65) formed therein, for engagement with a corresponding slot or key within the larger chamber, causing orientation of the smaller chamber junction (43) such that the additional orifice conduits (39) of each chamber junction are aligned.

FIG. 43 depicts a bore selection tool (47) sized for insertion into the smaller chamber junction of FIG. 42 having an extension member (48) at its lower end. After the smaller chamber junction has been inserted within the larger chamber junction, the depicted bore selection tool (47) is usable to isolate a selected additional orifice conduit, for enabling communication with a selected well bore, by completing the incomplete circumference of the selected additional orifice conduit. The bore selection tool (47) is depicted having a groove (53) and a cavity (54) at its upper end, usable for securing and manipulation of the bore selection tool (47) by an insertion and removal tool.

The bore selection tool (47) is shown having an eccentric bore (56) with a lower end (57) in alignment with the extension member (48), which is shown having a partial internal bore (68) sized to complete the circumference of a selected additional orifice conduit of the smaller chamber junction when inserted therein. An index key or slot (55) is shown, the key or slot (55) being configured to engage with a complementary key or slot within the chamber junction, thereby orienting the bore selection tool (47) to align the eccentric bore (56) with an additional orifice conduit.

When the bore selection tool (47) is inserted into the overlapping, cloverleaf-shaped securing point profile of the additional orifices of the chamber junction of FIG. 42, the partial internal bore (68) of the extension member (48) completes the circumference of the overlapping portion of the aligned additional orifice conduit, thereby providing the aligned additional orifice conduit with a full circumference to enable isolation from other additional orifice conduits.

As demonstrated in FIG. 8, FIG. 10 and FIGS. 40-46, and in the preceding and subsequent depicted and described embodiments, any angular orientation and configuration of additional orifice conduits, can be constructed between cut plane A-A and cut plane B-B and engaged with a chamber to form a chamber junction with full or partial circumferences at the securing points, to accommodate any desired well bore angular orientation, any length, and any configuration of additional orifices that can be made accessible and/or isolated using one or more corresponding bore selection tools with or without an extension member at its lower end. Generally, the angle of conduits that extend from the chamber junction affect the length of apparatuses that can pass through a chamber junction. Such angles generally range from 0 to 3 degrees per 100 feet in normal wells, however deflections of 5 to 15 degrees per 100 feet may be necessary, such as within short radius wells, while deflections of 15 to 30 degrees per 100 feet could be necessary if coiled tubing or similar means are used.

Referring now to FIG. 47, an alternate embodiment of a bore selection tool is shown, the bore selection tool (47) having a bore (56) and an extension member (48) disposed beneath the bore (56) at its lower end, as described previously. The depicted bore selection tool (47) is shown including one or more protrusions (69), usable as an alternate method for orienting the bore selection tool (47) within a chamber junction, the protrusions (69) being sized and configured for insertion into circulating ports and/or bypass conduits within the chamber.

FIGS. 48 through 50 depict an alternate embodiment of a chamber junction (43), having fluid bypass conduits, a wall covering the length of the additional orifice conduits (64), and seal stacks (66) disposed at its lower end, usable for engagement with other tools and/or equipment, including additional chamber junctions, such as that depicted in FIG. 41. The depicted chamber junction (43) is usable with the bore selection tool of FIG. 47. The chamber junction (43) is depicted having overlapping additional orifices (39) that diverge to become laterally separated at the lower end of the chamber junction (43). The chamber junction (43) is further depicted having multiple bypass conduits (59) extending therethrough, usable to flow fluid slurries, circulate and remove cuttings, place cement, and perform other similar operations. The bypass conduits (59) are also able to engage with the protrusions of the bore selection tool of FIG. 47 to provide orientation of the bore selection tool within the chamber junction (43). FIG. 49 depicts the internal surfaces of the chamber junction with dashed lines, illustrating the divergence of the additional orifice conduits from overlapping circumferences to fully separated conduits. The top isometric view of the chamber junction (43), depicted in FIG. 50, depicts the cloverleaf shape provided by the overlapping additional orifice conduits (39), while showing the full circumference of the upper right additional orifice conduit.

FIG. 51 depicts a top view of the chamber junction (43) of FIGS. 48 through 50 with the bore selection tool of FIG. 47 inserted therein. The bore (56) of the bore selection tool is shown disposed within the chamber junction (43), the bore selection tool having a diameter slightly less than that of the chamber. The extension member (48) is shown completing the circumference of the corresponding additional orifice conduit, thereby isolating the aligned additional orifice conduit from each other additional orifice conduit.

Figures 52, 53, 54, 55, 56, 57:
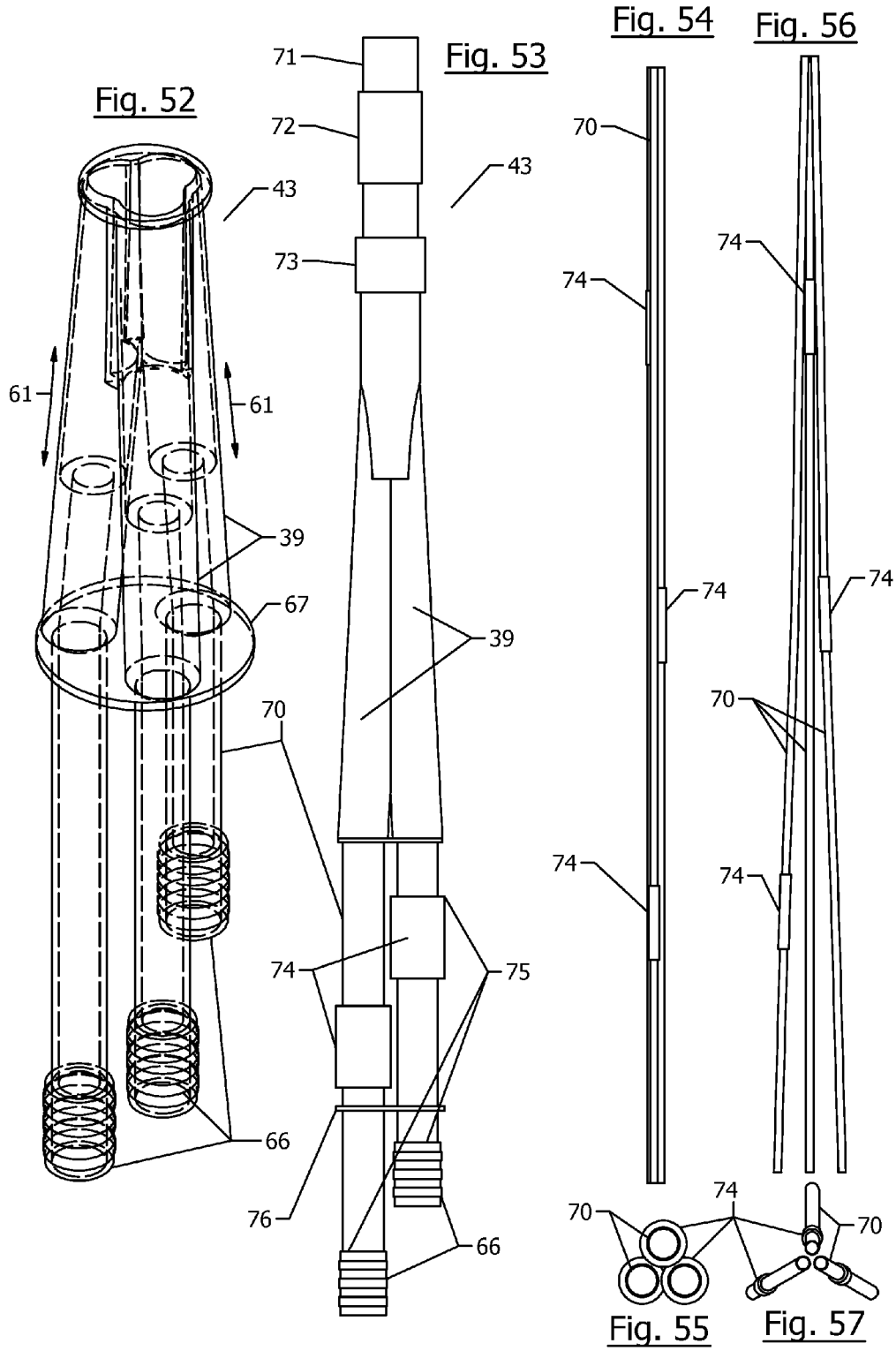
FIG. 52 depicts an isometric view of an embodiment of a chamber junction having flexible connector arrangements to facilitate installation.
FIG. 53 depicts an elevation view of an embodiment of a chamber junction having secured valves for controlling communication between the chamber and associated conduits.
FIGS. 54-57 depict diagrammatic views of the installation of conduits secured to the lower end of the chamber junction of FIG. 53, with FIGS. 55 and 57 depicting top plan views of FIGS. 54 and 56, respectively.

Referring now to FIG. 52, an embodiment of a chamber junction (43) that utilizes the conduit into which it is inserted as a chamber is depicted, having additional orifice conduits (39) that include flexible lower conduits (70) vertically spaced at their lower ends, having mandrel seal stacks (66) attached thereto, and sealing surfaces (61), such as polished bore receptacles, proximate to their upper ends. The depicted chamber junction (43) also includes a lower plate (67) usable to abut against the bottom of a chamber when the depicted chamber junction (43) is inserted into a larger chamber junction. As the depicted chamber junction (43) is inserted, the flexible lower conduits (70) can be guided and engaged with associated connection apparatuses in laterally separated well bores.

FIG. 53 depicts an elevation view of an alternate embodiment of the chamber junction (43) of FIG. 52, with cut plane A-A extended to the intersection between the centerlines of the additional orifice conduits with that of the first orifice of the chamber junction (43). The chamber junction (43) is shown having valves (74) disposed above the mandrel seal stacks (66). The valves (74) and seal stacks (66) are shown having offset spacing (75), to reduce the effective diameter of the overall construction to facilitate insertion within previously placed conduits and/or chamber junctions having a limited diameter. A lower conduit guide plate (76) engages the lower conduits (70) to separate bundled conduit strings for facilitating separation and connection with polished bore receptacles or other corresponding connectors. A connector (73) is also shown disposed above the first orifice of the chamber engaged to the additional orifice conduits (39), with an additional valve (72) and a securing conduit (71) disposed above, that when combined with the lower valves (74), transform the chamber junction into a header with a downhole manifold created by the addition of the valves. If the valves are hydraulically connected, the downhole manifold can become an intelligent completion capable of manipulating streams from a plurality of wells through the additional orifice conduits of the chamber junction.

Referring now to FIGS. 54-57, bundles (77) of smaller flexible conduits (70), diagrammatically represented by the flexible lower conduits and valves depicted in FIG. 53, are depicted with larger diameter apparatuses, such as subsurface safety valves (74) secured therein and spaced across the axial length of each flexible conduit (70). As bundled conduits are urged into a chamber junction, unbundling can be initiated to separate each flexible conduit (70) into a respective additional orifice conduit, as shown in FIGS. 56 and 57.

Referring now to FIGS. 58 and 59, an embodiment of a chamber junction (43) is shown having a chamber (41) accommodating two parallel additional orifice conduits (39), each communicating with a well bore, thereby defining a junction of wells (51). The additional orifice conduits (39) meet within the chamber (41) at securing points (44). The depicted chamber junction (43) can be formed by concentrically disposing a larger chamber junction about a smaller chamber junction that includes the two unconnected additional orifice conduits (39). The depicted configuration of two unconnected additional orifice conduits (39) enables simultaneous extraction and injection of substances into and from one or more well bores.

FIGS. 60 and 61 depict a bore selection tool (47) usable for insertion within the chamber junction (43) of FIGS. 58 and 59, the bore selection tool (47) having an internal bore (49) extending therethrough that terminates at a selection bore (50) positioned to align with an additional orifice of the chamber junction.

FIG. 62 depicts a junction of wells (51), which includes the chamber junction (43) of FIGS. 58 and 59 having the bore selection tool (47) of FIGS. 60 and 61 disposed therein. The internal bore (49) of the bore selection tool (47) is shown in alignment with one of the additional orifice conduits (39) proximate to the bottom (42) of the chamber junction.

Referring now to FIGS. 63 and 65, an embodiment of a chamber junction (43) is depicted that includes a large chamber junction disposed about a smaller chamber junction having three additional orifice conduits (39) accessible through two differently-sized upper openings, accommodated within a chamber (41). The additional orifice conduits (39) intersect the chamber (41) at a securing point (44). Each additional orifice conduit (39) communicates at its lower end with a differing well, the depicted composite structure thereby defining a junction of wells (51). The two differently sized upper openings depicted are usable, among other purposes, for simultaneous extraction and injection of substances into one or more well bores.

FIG. 64 depicts an embodiment of a bore selection tool (47), sized for insertion into the larger upper opening of the chamber junction of FIG. 65. The bore selection tool (47) has an internal bore (49) terminating in a selection bore (50), which is aligned with one of the additional orifice conduits of the chamber junction when the bore selection tool (47) is inserted therein.

FIG. 66 depicts the bore selection tool (47) of FIG. 64 inserted within the chamber junction (43) of FIG. 65, showing the selection bore (50) aligned with one of the additional orifice conduits, while isolating other additional orifice conduits.

As demonstrated in FIGS. 58-66 any configuration of additional orifice conduits can be provided to accommodate bi-directional flow through a chamber junction from any number and configuration of wells.

Referring now to FIG. 67, an embodiment of a chamber junction (43), having three additional orifice conduits (39) is shown, each of which are connected to a chamber engaged with a connector (73) at the top of the chamber junction (43), with a securing conduit (71) and a valve (72) disposed above. Lower flexible conduits (70) are shown secured to the lower end of each additional orifice conduit, the lower flexible conduits (70) having valves or chokes (74) in communication therewith, which are usable to transform the chamber junction into a header and the assembly into a manifold. Use of valves on either side of a chamber junction enables the chamber junction to function as a manifold through hydraulic control of the valves or chokes, thereby transforming the manifold into an intelligent completion usable to remotely direct the flow of various streams through the assembly.

The lower flexible conduits (70) pass through a guide plate (76), which facilitates separation and orientation of the lower flexible conduits (70), and can abut with the bottom of an adjacent chamber junction if the depicted chamber junction (43) is inserted therein. The lower flexible conduits (70) are further shown including mandrel seal stacks (66), which can engage complementary receptacles when the chamber junction (43) is inserted into a second chamber junction.

In an exemplary operative embodiment of the invention, the chamber junction of FIG. 67 can be inserted into the chamber junction of FIG. 42 which in turn can be inserted into the chamber junction of FIG. 41. The chamber junction of FIG. 41 can be engaged with the upper end of a configuration of laterally separated well bores, such as that depicted in FIG. 3, with conduits secured to the lower end of each chamber junction communicating with differing well bores.

FIG. 68 depicts an alternate embodiment of a chamber junction (43), with the upper end of the chamber junction of FIG. 67 removed and replaced by that shown in FIG. 68 at line M-M. The depicted chamber junction (43) is shown having two additional orifice conduits (39) engaged with a connector (79). Two conduits (71, 78) are also shown engaged with the connector (79) to communicate with the additional orifice conduits (39). A valve (72) is shown disposed in one of the conduits (71), typically used for extraction from one or more associated well bores, while a conduit is used for injection from a surface injection pump.

FIG. 69 depicts a top plan view of an embodiment of a chamber junction (43) with the upper end of the chamber junction of FIG. 67 removed and replaced by that shown in FIG. 68 at line M-M. The depicted chamber junction (43) includes two additional orifices (39) in communication with a first conduit (71), and one or more other additional orifices in communication with a second conduit (78). The depicted embodiment is useful for simultaneous injection operations alongside production operations, such as injecting lift gas or water into the second conduit (78) to facilitate production through the first conduit (71), or providing waste water, hydrocarbons for storage, or another type of input into the second conduit (78) while producing through the first conduit (71).

FIG. 70 depicts an embodiment of a chamber junction (43) that includes internal bores of the additional orifice conduits having angled surfaces (82) that diverge from the center of the chamber. Rollers (81) are shown disposed within each additional orifice conduit to serve as wear protection apparatuses during wire line operations. A receptacle (83) is shown within the approximate center of the chamber junction (43) for engagement with and orientation of a bore selection tool. The chamber junction (43) is also shown having multiple pass-through ports (80) for accommodating control lines during various operations when there is insufficient space to pass such lines outside of the chamber junction (43).

Referring now to FIG. 71, an embodiment of a lower portion (84) of a chamber junction is shown, having conduits (70) engaged with the lower ends of each additional orifice conduit. The conduits (70) are shown having numerous valves (74), including cross-over valves, enabling selective communication and isolation between selected conduits (70). Mandrel seal stacks (66) are also shown engaged with the ends of each conduit (70) after each conduit (70) passes through a guide plate (76), to facilitate separation and orientation of each conduit (70). When embodiments of the invention are utilized to produce from differing isolated fault blocks, such as depicted in FIG. 5, higher pressure production from a first fault block can be cross-flowed into other well bores, with possible permeable communication between other fault blocks. Production and pressure from higher pressure fault blocks can be used to sweep lower pressure fault blocks, with permeability between fault blocks acting as a pressure choke to facilitate production. Such embodiments of the invention have significant value, enabling lower permeability, higher pressure formations to be accessed simultaneously with lower pressure formations or higher pressure water flows used to flood lower pressure reservoirs, without requiring expensive water injection facilities.

FIGS. 58-71 illustrate that any configuration of additional orifice conduit openings can be used to accommodate bi-directional flow through a chamber junction that in turn can be combined with any configuration of downhole manifold of valves, chokes or other flow control apparatus, through a chamber junction acting as a header and/or manifold including crossover valves between manifold assembly inlet and/or outlet conduits to direct and redirect the flow of fluids and/or gases in any direction within system formed by the junction of wells.

FIG. 72 depicts an embodiment of a bore selection tool (47) usable for insertion within the chamber junction of FIG. 70, or a similar chamber junction. The bore selection tool (47) is shown including a sleeve (141) containing an extension member (48, depicted in FIGS. 73 and 74), and having a partial circumference selector (68) disposed therein, proximate to the selection bore (50), with surrounding wear resistant material, such as porcelain, for facilitating guidance of tools, tubing, and other elements through the selection bore (50) into an aligned well bore conduit.

FIGS. 73 and 74 depict the extension member (48) having the partial circumference selector (68) in greater detail. The partial circumference selector (68) can be tapered, eccentric, and/or conical, depending on the orientation of the respective additional orifice conduit to be accessed. A receptacle (54) is shown disposed within the extension member (48), with a groove (53) in the receptacle (54) usable to secure the extension member (48) to a tool, such as for insertion and/or retrieval. The receptacle (54) is shown including a fluid drain (85) for preventing hydraulic lock. The extension member (48) also includes one or more mandrels (86) and a guidance shoulder (69), such as a helical shoulder, for orienting the extension member (48).

Referring now to FIGS. 75 through 80, successive steps for constructing an embodiment of a chamber junction (43) usable with the present system are depicted.

FIG. 75 depicts a plan view of an embodiment of a chamber junction (43) that is formed by placing a larger chamber junction concentrically about a smaller chamber junction, with a small gap therebetween as a tolerance for fitting the two pieces together. FIG. 76 depicts an isometric sectional view of the chamber junction (43) of FIG. 75 along line N-N.

FIG. 77 depicts an isometric view of the section of FIG. 76 with the smaller chamber junction removed, such that the larger chamber junction (43) can be seen including a chamber (41) with a chamber bottom (42), the chamber (41) being secured to three additional orifice conduits (39) at securing points (44).

FIG. 78 depicts the larger chamber junction (43) of FIG. 77, with all portions that extend beyond a selected maximum diameter, shown as line O in FIG. 75, removed, forming truncated additional orifice conduits (46) at the securing points (44).

FIG. 79 depicts an isometric sectional view of the section of FIG. 76, with the larger chamber junction removed, such that the smaller chamber junction (43) is shown having a chamber (41) with a bottom (42), the chamber (41) being secured to additional orifice conduits (39) and unitized or split into parts along cut plane C-C-C as shown in FIG. 75.

FIG. 80 depicts an isometric sectional view of both chamber junctions (43), with material beyond a selected diameter removed from the larger chamber junction, as described previously. In the manner depicted in FIGS. 75 through 80, the smaller unitized chamber junction of FIG. 79 can be inserted in parts through a conduit and assembled by securing the parts to the larger chamber junction with material beyond a selected diameter removed, shown in FIG. 78. Each of the parts of the smaller chamber junction is sized to pass through a main composite bore and/or additional orifice conduits secured to said part prior to assembly of the chamber junction. A smaller chamber junction sized to fit within the larger chamber junction can thereby be split and inserted in parts through the main composite bore, into the larger chamber junction, thereby completing the additional orifice conduits of the larger chamber junction, truncated by removal of material beyond the selected diameter, such that parts of the smaller chamber junction are usable in a manner similar to conduit hangers within the larger chamber junction, which acts as a subterranean wellhead.

Figures 81, 82:
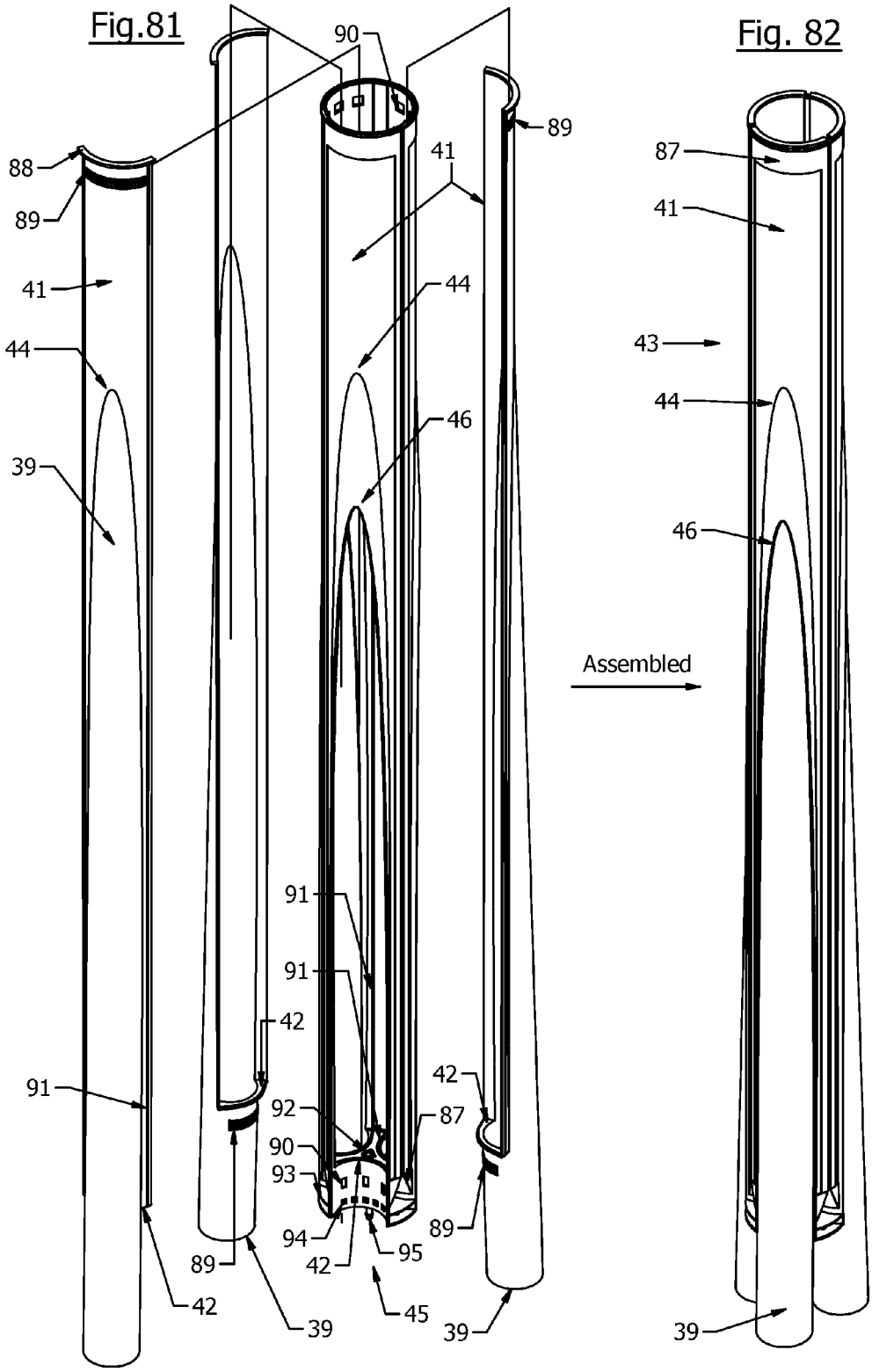
FIGS. 81 and 82 depict an embodiment of a multi-part chamber junction, with FIG. 81 depicting the individual parts of the chamber junction and FIG. 82 depicting the parts of FIG. 81 assembled.

FIGS. 81 through 97 illustrate an embodiment of multi-part chamber junctions for downhole assembly. FIG. 81 depicts a first chamber junction that has been split into three parts for insertion into a larger chamber junction with additional orifice conduits truncated by a maximum diameter, as described previously. Each piece of the smaller chamber junction includes additional orifice conduits (39), which intersect a chamber (41) at a securing point (44). The larger chamber junction is shown having material that exceeds a selected diameter removed, as described previously, such that truncated additional orifices (46) remain. The smaller chamber junction can be secured within the larger chamber junction through use of securing apparatuses (87, 89, 90) at one or both ends, in conjunction with differential pressure sealing apparatuses (88, 91). A mandrel (95) is shown disposed at the lower end of the larger chamber junction, proximate to a lower plate (93), for orienting the chamber junction when inserted into one or more conduits or other chamber junctions having a complementary receptacle for receiving the mandrel (96). Circulating ports (94) are also depicted for permitting circulation of fluid through the chamber junction. A receptacle (92) is also shown at the bottom (42) of the chamber junction for further permitting circulation of fluid and engagement with a bore selection tool, a chamber junction secured within, or other apparatuses.

In an embodiment of the invention, parts of the smaller chamber junction can be secured and pressure sealed through the first orifice of the larger chamber junction having truncated additional orifice conduits, such as by placing differential pressure bearing seals between chamber junction parts. After pressure sealing the smaller chamber junction to the larger chamber junction, circulation can be accomplished using the circulating ports (94), which are separated from the remainder of the chamber junction by the lower plate (93), entering or exiting the chamber through the receptacle (92). After fluid circulation, the receptacle (92) can be plugged and differentially pressure sealed to make the resulting chamber junction pressure bearing. The receptacle (92) is also usable to orient bore selection tools and other chamber junctions inserted therein by receiving a mandrel or similar orienting member.

FIG. 82 depicts a completed chamber junction (43) after each piece of the smaller chamber junction has been inserted into the larger chamber junction and secured using an actuating apparatus to activate securing apparatuses (87) placed within cavities (90) to interact with corresponding securing apparatuses (89). The completed chamber junction (43) is shown having the additional orifice conduits (39) of the smaller chamber junction protruding through the truncated additional orifices (46) of the larger chamber junction to form completed additional orifice conduits for communication with selected well bores. Additional orifice conduits are shown secured at their upper end to a chamber (41) at a securing point (44) and can have well bore conduits secured to their lower end during insertion into the larger chamber junction, effectively acting as a downhole wellhead, while the inserted portions of the smaller chamber junction act as a casing or tubing hanger for each additional orifice.

FIGS. 83 through 86 depict an embodiment of a securing tool (97) usable for insertion into one of the pieces of the split smaller chamber junction to create an assembly (96). The securing tool (97) is shown contacting both the upper end (98) and the lower end (99) of a portion of the split smaller chamber junction.

FIG. 84 depicts a cross sectional view of the securing tool (97) along line P-P of FIG. 83. FIGS. 85 and 86 depict detail views Q and R, respectively, of the cross section of FIG. 84. FIG. 85 depicts the detail view of the securing tool (97) and upper end (98) of the contacted portion of the chamber junction, while FIG. 86 depicts a detail view of the securing tool (97) at the lower end (99) of the chamber junction proximate to an additional orifice conduit (39). The securing tool (97) is shown providing compression to the upper end (98) at a sealing apparatus (91), such as a ring groove with an associated ring. The securing tool (97) is shown having an internal piston (101) secured to a shaft (102) within a cavity (100), the shaft (102) extending to the lower end (99) of the chamber junction, where it can be secured with a securing apparatus (103), depicted as locking dogs which would correspond to a cavity within an adjacent chamber junction, conduit, or other generally fixed member. In operation, pressure within the piston cavity (100) can expand the cavity, moving the shaft (102) and internal piston (101) to contact a desired portion of the smaller chamber junction and urge the portion of the smaller chamber junction toward the larger chamber junction. Force may be applied through the securing tool (97), or the securing tool (97) can be rotated to contact against desired portions of the chamber junction to create a securing force. The piston (101) can further apply compression to any sealing apparatus between the smaller junction parts and/or the larger chamber junction to secure one to the other and/or to effect a differential pressure sealing barrier between the parts.

FIGS. 87 through 91 depict embodiments of securing apparatuses used to secure parts of a smaller chamber junction within a larger chamber junction. A split portion of a smaller chamber junction is shown, having an additional orifice conduit (39) at its lower end, and a securing surface (89) at its upper end for engagement with a securing apparatus (105), shown in FIG. 89 as slip segments placed in cavities (90) at the upper end and actuated by an actuating apparatus (87). A similar securing surface (89, depicted in FIG. 81), is also present at the lower end of the smaller chamber junction part for engagement with a securing apparatus, placed in cavities at the lower end and actuated by the actuating apparatus (87). Ring grooves (91) are also usable for containing rings (104) to facilitate differential pressure sealing between the depicted chamber junction portion and adjacent members, such that compression applied by the securing tool and locked in place by the securing apparatuses effects a differential pressure seal.

The securing apparatus (87) is placed over slip segments (105), such as the slip segment (105) depicted in FIG. 89, which can be inserted into cavities (90) disposed proximate to the ends of the larger chamber junction, such that the slip segments (105) contact the securing surface (89) of the smaller chamber junction piece when it is inserted within the larger chamber junction.

FIG. 88 depicts a detail view of the upper end of the larger chamber junction, proximate to a securing and sealing extension (88) at the upper end of two installed smaller chamber junction parts usable to secure the smaller chamber junction parts to the larger chamber junction. FIG. 88 shows the cavities (90) for receiving slip segments, and a ring (104) disposed within a ring groove for sealing with adjacent members. FIG. 90 depicts a detail view of the upper end of the smaller chamber junction part, having a securing and sealing extension (88), as described previously, and securing surface (89) disposed thereon, proximate to ring grooves (91). FIG. 91 depicts a detail view of the lower end of the larger chamber junction, depicting cavities (90) where slip segments can be inserted for contact with the securing surface disposed on the smaller chamber junction part proximate to the additional orifice conduit (39). Circulating ports (94) are separated from the securing cavities (90) by a separating plate. A receptacle (92) is usable to flow fluid through the chamber junction past the separating plate (93) from the circulating ports (94). A mandrel (95) is also shown, for orienting and securing the chamber junction during insertion into a larger chamber junction with a corresponding receptacle (92), the mandrel (95) including a ring (106) or similar protruding body to enable securing of the mandrel (95) within a complementary receptacle.

Referring now to FIG. 92, a plan view of the assembled chamber junction (43) of FIG. 82 is shown, the depicted chamber junction (43) being formed from a split smaller chamber junction secured within a larger chamber junction.

FIG. 93 depicts an elevated cross sectional view of the chamber junction (43) of FIG. 92 along line V-V, depicting two additional orifice conduits of the smaller chamber junction protruding from the truncated additional orifice conduits (46) of the larger chamber junction.

FIG. 94 depicts a cross sectional elevation detail of the upper portion of the chamber junction of FIG. 93, engaged with an actuating apparatus (87) used to actuate a slip segment (105), placed within a cavity (90) against a securing surface (89). FIG. 94 illustrates the chamber (41) portion of the split smaller chamber junction, within a sealing apparatus (104), which is depicted as a hexagonal ring within associated grooves between securing and sealing extensions (88) of the smaller and larger chamber junctions. The chamber junction is shown having a cavity (90), within which a slip segment (105) is disposed such that securing of the chamber junction using the actuating apparatus (87) engages the slip segment (105) with the securing surface (89) of the chamber junction, effecting a differential pressure seal between ring grooves (91) placed in the chamber (41), the securing and sealing extensions (88), the chamber bottom (42) of the smaller and larger chambers, and the sealing apparatus (104).

FIG. 95 depicts a cross sectional elevation detail view of the lower portion of the chamber junction of FIG. 93, showing circulation porting and hydraulic actuation porting for the actuating apparatus (87), and the orientation and securing receptacle (92) in which an additional orifice conduit (39) is visible. A sealing apparatus (104), depicted as a hexagonal ring, is shown disposed intermediate to the bottom (42) of the chamber junctions. A slip segment (105) is shown disposed within a cavity (90) of the chamber junction, in a manner similar to that depicted in FIG. 94, such that force applied by the securing apparatus (87) engages the slip segment (105) with the securing surface (89). The slip segment (105) can thereby be held in place by its shape relative to the complementary securing surface (89), once actuated by the actuating apparatus (87). The actuating apparatus (87) can cause engagement of the slip segment (105) using a piston (not shown) through use of hydraulic ports (108, 109) for moving the actuating apparatus (87) to subsequently move the slip segment (105) to contact the securing surface (89) on the additional orifice conduit (39), thus enabling engagement and disengagement of the smaller chamber junction part from the larger chamber junction. A mandrel can be placed within the receptacle to isolate the hydraulic ports (108, 109) and lock hydraulic pressure into the pistons as a secondary locking mechanism, for securing the actuating apparatus (87) and preventing unintentional movement of the securing surface (89) or slip segment (105).

The mandrel (95) is shown protruding from beneath the chamber junction, which is intended for insertion within a corresponding mandrel receptacle (92), for providing orientation of the chamber junction through engagement with another member, facilitated by a ring (106) or similar protruding portion of the mandrel (95), adapted to engage and/or lock within a complementary receptacle. When two chamber junctions are engaged in this manner, the protruding portion of a first chamber junction mandrel can lock within a cavity (107) of a second chamber junction.

Circulation ports (110) between the receptacle (92) and the circulation ports (94) proximate to the circulation gap between the additional orifice conduits of the smaller chamber junction and the truncated additional orifice conduits of the larger chamber junction are provided to enable the flow of circulating fluid, while check valves within the hydraulic ports (108, 109), that can be disengaged with a mandrel, can be used to maintain hydraulic fluid separate from circulated fluid through the circulation ports (110). Circulating passages (94) are also shown disposed within the chamber junction, separated from securing apparatuses by a lower plate (93) to contain the circulation passageways.

Figure 96:
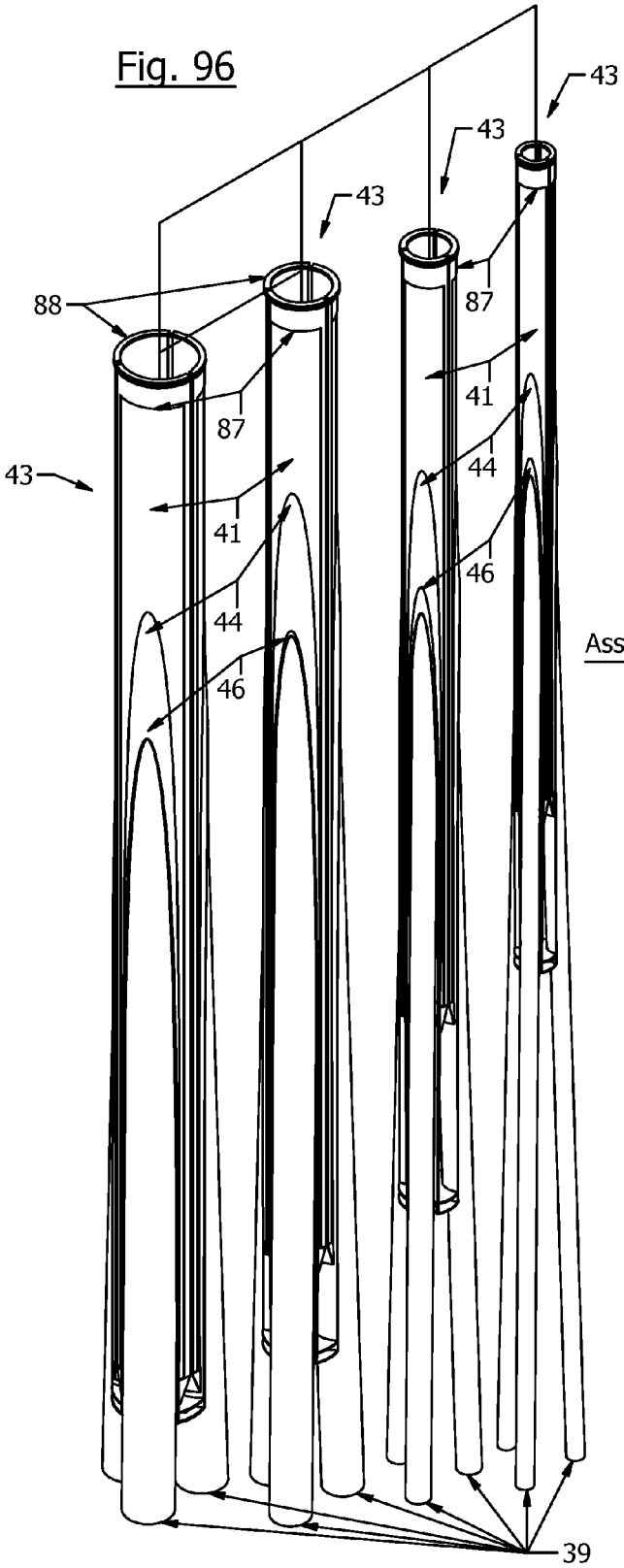
FIGS. 96 and 97 depict an embodiment of a multi-part and multi-walled chamber junction, with FIG. 96 depicting the individual parts of the chamber junction and FIG. 97 depicting the parts of FIG. 96 assembled.
Figure 97:
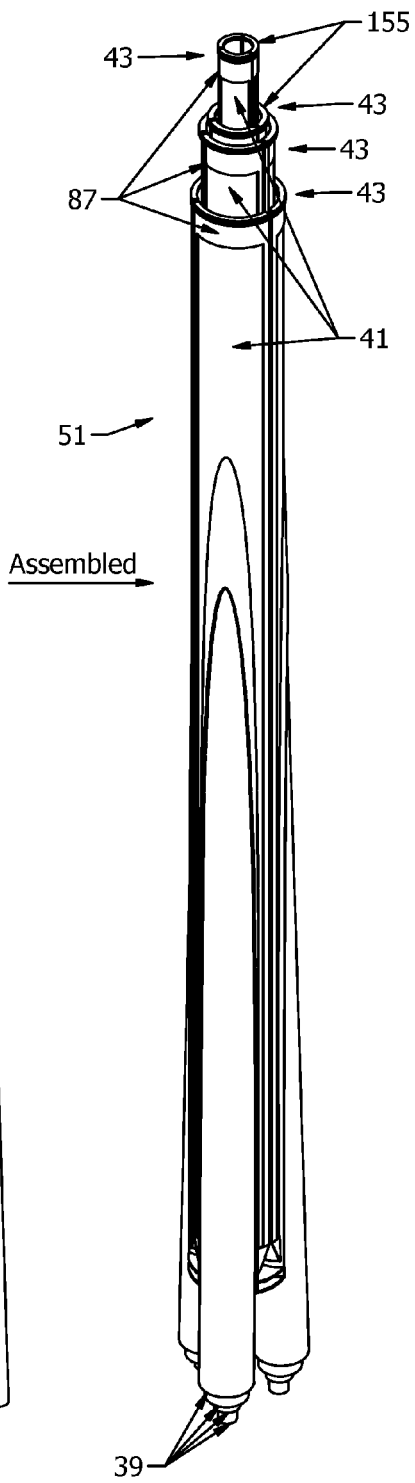

Referring now to FIGS. 96 and 97, four chamber junctions, configured as shown in the embodiments depicted in FIGS. 81 through 95, of differing sizes that are comparable to conventional well conduits are shown. FIG. 96 depicts each chamber junction (43) separated from one another, while FIG. 97 depicts an assembled view of a completed chamber junction, with each individual chamber junction (43) concentrically disposed about one another. Each chamber junction (43) includes a chamber (41) in communication with multiple additional orifice conduits (39) at securing points (44), as described previously, such that when assembled, each additional orifice conduit (39) forms a concentric conduit with multiple barriers between the conduit and the exterior environment. Similarly, the chambers (41) of the assembled chamber junction form a concentric chamber with multiple walls. The additional orifice conduits (39) of the smaller chamber junctions protrude through truncated additional orifices (46) of larger chamber junctions. An actuating apparatus (87) is usable to secure the parts of the multiple chamber junctions (43) together in the manner described previously. Additionally, each chamber junction (43) is shown having a securing and sealing extension (88) disposed proximate to its upper end (155), usable to secure conduits to the upper ends of the chamber junctions, while conduits of multiple wells can be secured to the lower end of the additional orifice conduits (39). As previously described, the larger chamber junction having truncated additional orifice conduits effectively acts as a downhole wellhead, while the separated smaller chamber junction parts act as a complementary casing or tubing hanger, facilitating sizing of conduits within the system.

As shown in FIGS. 81 through 97, embodiments of the present invention are usable to reduce size limitations associated with downhole placement of chamber junctions to accommodate a range of conduit sizes equal to or greater than those conventionally used, and to accommodate a wide variety of multiple well configurations.

The present invention thereby provides systems and methods that enable any configuration or orientation of wells within a region to be operated through a single main bore, using one or more chamber junctions with associated conduits. A minimum of above-ground equipment is thereby required to selectively operate any number and any type of wells, independently or simultaneously, and various embodiments of the present systems and methods are usable within near surface subterranean strata.

While various embodiments of the present invention have been described with emphasis, it should be understood that within the scope of the appended claims, the present invention might be practiced other than as specifically described herein.

What is claimed is:

1. A system for operating a plurality of wells through a single main bore comprising one or more conduits, said wells having annular passageways surrounding internal well bores, the system comprising:

at least one chamber junction comprising an exterior chamber member and an interior chamber member disposed within the exterior chamber member, with an annular passageway defined between the interior and exterior chamber members and communicating with the annular passageways of said wells, two or more internal passageways extending outwardly from respective orifices in said interior chamber member through said annular passageway defined between the interior and exterior chamber members and through said exterior chamber member to provide selective communication between said internal well bores of said plurality of wells and said one or more conduits.

2. The system of claim 1, wherein the internal passageways extend downwardly from an upper end of said interior chamber member, the system further comprising one or more bore selection tools sized for alignment with said orifices and insertion through at least one of the two or more internal passageways, an upper opening aligned with a first orifice of the interior chamber member, and at least one lower opening, wherein each at least one lower opening is aligned with a selected orifice of the interior chamber member, wherein the bore selection tool prevents communication with at least one other orifice.

3. The system of claim 1, further comprising at least two valves or chokes controlling flow through said internal passageways, thereby forming a manifold disposed beneath the earth's surface in communication with said plurality of wells, wherein substances can be provided or removed to or from at least two wells of the plurality of wells simultaneously through said manifold.

4. The system of claim 1, wherein said exterior chamber member, said interior chamber member, or combinations thereof comprises a plurality of parts, and wherein each part of the plurality of parts has a maximum transverse dimension less than the inner diameter of the single main bore for enabling passage of each part of the plurality of parts through the single main bore for downhole assembly of said member.

5. A method for operating a plurality of wells through a single main bore comprising one or more conduits, the method comprising the steps of:

locating a chamber junction exterior member at the lower end of the single main bore and providing communication between one or more internal passageways of said chamber junction exterior member with the one or more conduits of the single main bore;

orienting a bore selection tool within the one or more internal passageways of said chamber junction exterior member and urging a passageway through two or more orifices of said chamber junction exterior member axially downward through subterranean strata, placing conduits between the subterranean strata and said passageways through the orifices, forming a plurality of wells;

removing said bore selection tool from said chamber junction exterior member;

engaging a chamber junction interior member within said chamber junction exterior member at the lower end of the single main bore, said chamber junction interior member having two or more internal passageways, and providing communication between the two or more internal passageways of said chamber junction interior member with the one or more conduits of the single main bore forming a chamber junction;

orienting a bore selection tool within one or more passageways of said chamber junction interior member and urging a passageway through two or more orifices of said chamber junction interior member axially downward through subterranean strata, placing conduits between the subterranean strata and said passageways through two or more of the orifices of said chamber junction interior member, forming an annular passageway between said interior and exterior members in communication with the annular passageways between said conduits within said plurality of wells; and providing or removing fluids, slurries, gas, or combinations thereof to or from said plurality of wells through the internal passageways, annular passageways, or combinations thereof.

6. The method of claim 5, further comprising the steps of controlling flow through the passageways of said at least one chamber junction with flow control devices, thereby forming at least one manifold disposed beneath the earth's surface in communication with said plurality of wells, wherein substances are provided or removed to or from at least two wells of the plurality of wells simultaneously through said at least one manifold.

7. The method of claim 6, further comprising the step of providing a single valve tree to the upper end of the single main bore engaging one or more conduits at the upper end of the at least one manifold having internal passageways communicating with said plurality of wells, thereby reducing the quantity of above ground apparatus required to interact with the plurality of wells.

8. The method of claim 5, wherein said annular passageways are used to provide or remove fluid, slurries, gas, or combinations thereof from the list comprising: gas for gas lifting, storage, pressure maintenance, or gas flooding; waste substances for injection, removal, or disposal; fluid for storage, disposal, or to facilitate production; slurry for disposal or well construction; or combinations thereof.

9. The method of claim 5, further comprising the steps of assembling said chamber junction external member, said chamber junction internal member, or combinations thereof in parts below the earth's surface.

10. The method of claim 9, wherein said conduits are connected to radially disposed subterranean conduit hangers secured to a subterranean wellhead comprising said chamber junction member.

11. The method of any of claim 5, wherein the step of urging a passageway comprises using a rig disposed at a surface location to urge at least two passageways axially downward wherein said at least two urged passageways through subterranean strata begin at substantially the same subterranean depth and pass through similar subterranean strata prior to reaching a final subterranean depth, the method further comprising the step of utilizing information from a preceding urging of a passageway to modify the urging of subsequent passageways through subterranean strata.

12. The method of claim 5, wherein at least two bores through subterranean strata laterally separate within an uppermost geologic era of said subterranean strata to engage different features in the subterranean strata, and wherein the at least two bores pass through one or more complete geologic epoch time periods in said subterranean strata.

13. A method for providing communication with a plurality of wells through a single main bore comprising at least one conduit, the method comprising the steps of:

i) providing a chamber junction, said chamber junction comprising:

a main conduit having an open upper end and a closed lower end forming a chamber, and having a plurality of downwardly diverging conduits circumferentially disposed about and intersecting said main conduit at additional orifices to communicate with said chamber, wherein at least one of the downwardly diverging conduits comprises an incomplete circumference intersecting the chamber at its upper end, and wherein a bore selection tool comprises an extension member shaped to complete the partial circumference of the at least one of the downwardly diverging conduits when the bore selection tool is inserted into said main conduit;

ii) engaging said main conduit with said at least one conduit of the single main bore; and iii) engaging at least two of the plurality of downwardly diverging conduits with selected wells of the plurality of wells, thereby enabling communication with each of the plurality of wells through the single main bore and the chamber junction.

14. The method of claim 13, further comprising the steps of:

providing the bore selection tool having an upper opening, and a lower opening wherein the bore selection tool has a diameter less than the diameter of said main conduit for insertion into said main conduit;

inserting the bore selection tool into said main conduit; and aligning said extension member and the lower opening of the bore selection tool with a selected additional orifice thereby providing access to at least one of the plurality of downwardly diverging conduits while the bore selection tool isolates at least one other of the plurality of downwardly diverging conduits.

15. The method of claim 13, further comprising the step of providing the bore selection tool with an interior guiding surface and extension member proximate to the lower opening for enabling guidance of fluid, slurry, gas, objects, or combinations thereof passed through the upper opening bore selection tool to the lower opening and into said at least one of the plurality of downwardly diverging conduits.

16. A method for providing communication with a plurality of wells through a single main bore comprising at least one conduit, the method comprising the steps of:

providing a first chamber junction comprising a first chamber, a first upper orifice in communication with said at least one conduit of the single main bore, and a plurality of additional orifices, wherein the plurality of additional orifices are truncated at a diameter to enable insertion through a subterranean bore or conduit bore;

providing a second chamber junction comprising a plurality of segregated parts, wherein each part of the second chamber junction comprises a partial circumference of a second chamber and an additional orifice conduit, and wherein each part of the second chamber junction is sized for insertion through the first upper orifice of the first chamber junction; and sequentially inserting each part of the second chamber junction into the first chamber junction such that each additional orifice conduit of the second chamber junction is coincident with and extends through a truncated additional orifice of the first chamber junction, wherein each partial circumference of the second chamber junction forms a conduit hanger secured to and radially disposed within the first chamber, and wherein the first chamber junction forms a wellhead for securing conduit hangers.

17. A system for operating a plurality of wells through a single main bore comprising at least one conduit, the system comprising:

at least one chamber junction comprising a plurality of parts and a first orifice in communication with said at least one conduit and a plurality of additional orifices, wherein each additional orifice of the plurality of additional orifices is in communication with a selected well of the plurality of wells, wherein each part of the plurality of parts has a maximum transverse dimension less than an inner diameter of the single main bore for enabling passage of each part of the plurality of parts through the single main bore for downhole assembly of said at least one chamber junction, and wherein said at least one chamber junction comprises a first chamber junction having a first diameter and a second chamber junction having a second diameter, wherein the first diameter is larger than the second diameter, and wherein the first chamber junction surrounds the second chamber junction providing an intermediate annulus between the first and second chamber junctions in communication with at least one of said plurality of wells; and a bore selection tool sized for insertion through the first orifice and alignable with at least one additional orifice of the plurality of additional orifices, wherein the bore selection tool comprises an upper opening aligned with the first orifice, and at least one lower opening, wherein each lower opening is selectively alignable with one of the plurality of additional orifices, and wherein the bore selection tool prevents communication with at least one of the additional orifices.

18. The system of claim 17, wherein said at least one chamber junction comprises a first chamber junction comprising a plurality of orifices and a second chamber junction engaged with a selected orifice of the first chamber junction.

19. The system of claim 17, wherein the bore selection tool is rotatably movable within the first orifice, axially movable within the first orifice, or combinations thereof, wherein movement of the bore selection tool aligns said at least one lower opening with a differing additional orifice of the plurality of additional orifices, and wherein movement of the bore selection tool prevents communication with at least one differing additional orifice of the plurality of additional orifices.

20. The system of claim 17, wherein each additional orifice of the plurality of additional orifices is rotationally displaced from each other additional orifice, vertically displaced from each other additional orifice, or combinations thereof.

21. The system of claim 17, further comprising at least one isolation device or choke disposed within at least one of the wells, at least one of the additional orifices, or combinations thereof, wherein an annulus between said at least one of the wells, said at least one of the additional orifices, or combinations thereof and the second chamber junction is usable at a pressure greater or less than a pressure of at least one other of the wells, of at least one other portion of the system, or combinations thereof.

22. The system of claim 17, further comprising at least one chamber junction, in communication with at least two valves forming at least one manifold disposed within an annulus between a surrounding chamber junction and the second chamber junction beneath the earth's surface in communication with said plurality of wells.

23. The system of claim 17, further comprising a securing tool engageable with one or more of the plurality of parts, wherein the securing tool applies force to at least one part of the plurality of parts to establish contact between the at least one part and at least one other part of the plurality of parts, wherein said applied force results from engagement of a piston within said securing tool, rotation of said securing tool, application of axial force to either end of said securing tool, or combinations thereof.

24. The system of claim 17, further comprising a single valve tree in communication with an upper end of the single main bore, wherein the single valve tree is operable to communicate with any well of the plurality of wells.

25. The system of claim 17, wherein said at least one conduit of the single main bore comprises at least a first conduit usable for production and at least a second conduit usable for transporting substances into at least one well of the plurality of wells.

26. The system of claim 17, wherein the plurality of additional orifices comprises at least three additional orifices for independent or simultaneous communication with at least three wells of the plurality of wells, wherein said bore selection tool prevents communication with at least two of said at least three wells of the plurality of wells.

27. The system of claim 17, wherein said at least one chamber junction, the bore selection tool, or combinations thereof, comprise a projection configured for engagement within a complementary recess disposed within the other of the bore selection tool, said at least one chamber junction, or combinations thereof, and wherein engagement between the projection and the complementary recess orients the bore selection tool, completes the incomplete circumference of the at least one additional orifice, or combinations thereof such that said at least one lower opening is aligned with at least one of the additional orifices of said at least one chamber junction.

28. The system of claim 17, wherein said at least one chamber junction further comprises at least one engagement orifice for communicating fluid, slurry, gas, or combinations thereof between an annulus and the chamber junction, for engaging a bore selector tool, for engaging another chamber junction, or combinations thereof.

29. The system of claim 28, wherein the bore selection tool comprises at least one protrusion sized to engage the at least one ef engagement orifice, and wherein engagement between said at least one protrusion and said at least one engagement orifice orients the bore selection tool such that said at least one lower opening is aligned with at least one of the additional orifices of said at least one chamber junction.

30. The system of claim 17, wherein the bore selection tool comprises a receptacle disposed above the upper opening, wherein the receptacle is configured to engage a placement tool, a retrieval tool, or combinations thereof.

31. A method for operating a plurality of wells through a single main bore comprising at least one conduit, the method comprising the steps of:

engaging a chamber junction with a lower end of the at least one conduit and providing a plurality of parts of the chamber junction through said at least one conduit, wherein each part of the plurality of parts comprises a maximum transverse dimension less than the inner diameter of said at least one conduit for enabling passage of each part of the plurality of parts through said at least one conduit;

assembling the plurality of parts to form the chamber junction, wherein the chamber junction comprises a first orifice and a plurality of additional orifices;

placing the first orifice of the chamber junction in communication with said at least one conduit;

placing at least two of the additional orifices in communication with a selected well of the plurality of wells;

inserting a bore selection tool into said at least one conduit, wherein the bore selection tool comprises a first opening and at least one second opening; and orienting the bore selection tool within said at least one conduit, wherein the first opening is aligned with the first orifice of the chamber junction, the at least one second opening is aligned with an additional orifice of the plurality of additional orifices, and the bore selection tool prevents communication between the chamber junction and at least one of the additional orifices of the plurality of additional orifices.

32. The method of claim 31, further comprising the step of providing an annulus for the provision or removal of substances into or from at least one well of the plurality of wells by providing at least one additional chamber junction having a diameter that differs from the diameter of the chamber junction, and engaging the chamber junction with said at least one additional chamber junction such that the chamber junction and said at least one additional chamber junction are disposed with one inside the other.

33. The method of claim 31, further comprising the step of providing at least one additional chamber junction and engaging said at least one additional chamber junction with a selected orifice of the chamber junction.

34. The method of claim 31, further comprising the step of rotating the bore selection tool within said at least one conduit, axially moving the bore selection tool within said at least one conduit, or combinations thereof, to align said at least one lower opening with a differing additional orifice of the plurality of orifices and to align the bore selection tool to prevent communication with at least one differing additional orifice of the plurality of orifices.

35. The method of claim 31, further comprising the step of providing at least one isolation or choke device within at least one of the wells, at least one of the additional orifices, or combinations thereof.

36. The method of claim 31, wherein the step of engaging the chamber junction with the lower end of said at least one conduit comprises engaging the chamber junction, with at least two valves forming at least one manifold beneath the earth's surface.

37. The method of claim 31, wherein the step of assembling the plurality of parts to form the chamber junction comprises providing force from the engagement of a securing tool piston, rotational engagement of a securing tool, applied axial force from either end of a securing tool, or combinations thereof to establish contact between at least one part and at least one other part of the plurality of parts.

38. The method of claim 31, further comprising the step of providing a single valve tree in communication with an upper end of the single main bore, wherein the single valve tree is operable to communicate with any well of the plurality of wells.

39. The method of claim 31, wherein said at least one conduit of the single main bore comprises at least a first conduit usable for production and at least a second conduit usable for transporting substances into at least one well of the plurality of wells, the method further comprising the step of: producing substances from at least one of the wells through said at least a first conduit, said at least a second conduit, or combinations thereof, while transporting substances into at least one of the wells through said at least a first conduit, said at least a second conduit, or combinations thereof for facilitating production of one of the wells, maintaining pressure of one of the wells, disposing or storing materials within one of the wells, or combinations thereof.

40. The method of claim 31, wherein the step of orienting said bore selection tool within the single conduit comprises engaging a projection disposed on the bore selection tool, the chamber junction, or combinations thereof, with a complementary recess disposed within the other of the bore selection tool, the chamber junction, or combinations thereof, and wherein engagement between the projection and the complementary recess orients the bore selection tool such that said at least one lower opening is aligned with at least one of the additional orifices of the chamber junction.

41. The method of claim 31, further comprising the step of providing at least one engagement orifice in the chamber junction for communicating fluid, slurry, gas or combinations thereof between an annulus and the chamber junction, for engaging a bore selection tool, for engaging another chamber junction, or combinations thereof.

42. The method of claim 31, wherein at least one of the additional orifices comprises an incomplete circumference, and wherein the step of inserting the bore selection tool into the single conduit comprises passing an extension member of the bore selection tool through said at least one of the additional orifices to complete the incomplete circumference of the at least one additional orifice.

43. A differential pressure sealed containment system for using a plurality of well bores, the system comprising:

a plurality of subterranean concentric differential pressure containment assemblies comprising a plurality of concentric differential pressure containment chambers having upper ends engaged with the lower end of a single valve tree, wherein each of said plurality of differential pressure containment chamber's lower ends is engaged to upper ends of a plurality of connectors oriented as inclination deflection tubes for communication with said plurality of well bores, wherein the lower ends of said plurality of connectors comprise sealing mandrels for engagement with associated receptacles engaged at the upper end of a plurality of intermediate casings, wherein a passageway within each of said plurality of intermediate casing lower ends is engaged to one or more produced medium subterranean strata formations, one or more injection medium subterranean strata formations, or combinations thereof at the lower end of said plurality of well bores, wherein the engagement of a concentric differential pressure containment chamber and associated plurality of connectors forms a differential pressure envelope, wherein the innermost differential pressure envelope forms a production header controlled by two or more flow control devices, thereby defining a tubing manifold for accommodating provision or removal of production media or injection media to or from the passageways within the plurality of intermediate casings engaged with one or more produced medium subterranean strata formations, one or more injection medium subterranean strata locations, or combinations thereof, and wherein the annulus space between differential pressure envelopes can be positively, atmospheric or negatively pressured.

44. A method for using a differential pressure sealed containment system for a plurality of well bores, the method comprising the steps of:

locating at the lower end of a bore, a differential pressure containment chamber with a wellhead housing connected to its upper end and an associated plurality of connectors oriented as inclination deflection tubes connected to its lower end and forming a differential pressure envelope:

urging bores through one or more subterranean strata via the plurality of connectors oriented as inclination deflection tubes:

lining said urged bores with intermediate casings having sealing receptacles at their upper ends;

connecting the differential pressure containment chamber with a wellhead housing and connecting said sealing mandrels with said mandrel receptacles;

urging further bores via the plurality of connectors downward through one or more subterranean strata, and placing additional intermediate casings and forming additional differential pressure containment envelopes until intermediate casing has been placed across the targeted one or more production medium subterranean strata formations, one or more injection medium subterranean strata formations, or combinations thereof and a production or injection passageway has been created for each of the plurality of wells; and connecting at least an innermost differential pressure envelope as a production header controlled by two or more flow control devices forming a tubing manifold thereby enabling production media or injection media to be provided or removed, wherein positive, atmospheric or negative pressure is applied to annular regions between said differential pressure envelopes.

45. Wellbore completion apparatus for completing a plurality of wellbores from a single location, the apparatus comprising:

i) a differential pressure containment chamber having a plurality of connectors extending downwardly therefrom, the connectors terminating in mandrels; and ii) intermediate casings extending downwardly to said plurality of wellbores, said intermediate casings terminating at upper ends in a plurality of intermediate casing receptacles arranged to receive the respective mandrels, said intermediate casings extending downwardly through a template which can be sealed to subterranean rock formations whereby a differential pressure sealed envelope is formed.

46. Wellbore completion apparatus according to claim 45, wherein said receptacles are polished bore receptacles and said mandrels are polished bore receptacle mandrels.

47. Wellbore completion apparatus according to claim 45, further comprising means for commingling produced streams into a single production stream from a plurality of independent production streams in a sealed containment system.

48. Wellbore completion apparatus according to claim 47, further comprising means for controlling the pressure contained in the annulus space between two such differential pressure sealed envelopes, whereby the pressure is made positive, atmospheric or negative.

49. Wellbore completion apparatus according to claim 47, further comprising means for subterranean commingling of the mediums.

50. A system for operating a plurality of wells through a single main bore comprising at least one conduit, the system comprising:

at least one chamber junction comprising a first orifice in communication with said at least one conduit and a plurality of additional orifices, wherein each additional orifice of the plurality of additional orifices is in communication with a selected well of the plurality of wells, wherein said at least one chamber junction further comprises at least one engagement orifice for communicating fluid, slurry, gas, or combinations thereof between an annulus and the chamber junction, for engaging a bore selector tool, for engaging another chamber junction, or combinations thereof; and a bore selection tool sized for insertion through the first orifice and alignable with at least one additional orifice of the plurality of additional orifices, wherein the bore selection tool comprises an upper opening aligned with the first orifice, and at least one lower opening, wherein each lower opening is selectively alignable with one of the plurality of additional orifices, and wherein the bore selection tool prevents communication with at least one of the additional orifices.

51. A method for operating a plurality of wells through a single main bore comprising at least one conduit, wherein said at least one conduit of the single main bore comprises at least a first conduit usable for production and at least a second conduit usable for transporting substances into at least one well of the plurality of wells, the method comprising the steps of:

engaging a chamber junction with a lower end of the at least one conduit, wherein the chamber junction comprises a first orifice and a plurality of additional orifices;

placing the first orifice of the chamber junction in communication with said at least one conduit;

placing at least two of the additional orifices in communication with a selected well of the plurality of wells;

inserting a bore selection tool into said at least one conduit, wherein the bore selection tool comprises a first opening and at least one second opening;

orienting the bore selection tool within said at least one conduit, wherein the first opening is aligned with the first orifice of the chamber junction, the at least one second opening is aligned with an additional orifice of the plurality of additional orifices, and the bore selection tool prevents communication between the chamber junction and at least one of the additional orifices of the plurality of additional orifices; and producing substances from at least one of the wells through said at least a first conduit, said at least a second conduit, or combinations thereof, while transporting substances into at least one of the wells through said at least a first conduit, said at least a second conduit, or combinations thereof for facilitating production of one of the wells, maintaining pressure of one of the wells, disposing or storing materials within one of the wells, or combinations thereof.

52. A method for operating a plurality of wells through a single main bore comprising at least one conduit, the method comprising the steps of:

engaging a chamber junction with a lower end of the at least one conduit, wherein the chamber junction comprises a first orifice and a plurality of additional orifices;

providing at least one engagement orifice in the chamber junction for communicating fluid, slurry, gas or combinations thereof between an annulus and the chamber junction, for engaging a bore selection tool, for engaging another chamber junction, or combinations thereof;

placing the first orifice of the chamber junction in communication with said at least one conduit;

placing at least two of the additional orifices in communication with a selected well of the plurality of wells;

inserting a bore selection tool into said at least one conduit, wherein the bore selection tool comprises a first opening and at least one second opening; and orienting the bore selection tool within said at least one conduit, wherein the first opening is aligned with the first orifice of the chamber junction, the at least one second opening is aligned with an additional orifice of the plurality of additional orifices, and the bore selection tool prevents communication between the chamber junction and at least one of the additional orifices of the plurality of additional orifices.

53. A method for operating a plurality of wells through a single main bore comprising at least one conduit, the method comprising the steps of:

engaging a chamber junction with a lower end of the at least one conduit, wherein the chamber junction comprises a first orifice and a plurality of additional orifices, and wherein at least one of the additional orifices comprises an incomplete circumference;

placing the first orifice of the chamber junction in communication with said at least one conduit;

placing at least two of the additional orifices in communication with a selected well of the plurality of wells;

inserting a bore selection tool into said at least one conduit by passing an extension member of the bore selection tool through said at least one of the additional orifices to complete the incomplete circumference of the at least one additional orifice, wherein the bore selection tool comprises a first opening and at least one second opening; and orienting the bore selection tool within said at least one conduit, wherein the first opening is aligned with the first orifice of the chamber junction, the at least one second opening is aligned with an additional orifice of the plurality of additional orifices, and the bore selection tool prevents communication between the chamber junction and at least one of the additional orifices of the plurality of additional orifices.

* * * * *